US006302039B1

(12) United States Patent
MacCallum et al.

(10) Patent No.: US 6,302,039 B1
(45) Date of Patent: Oct. 16, 2001

(54) METHOD AND APPARATUS FOR FURTHER IMPROVING FLUID FLOW AND GAS MIXING IN BOILERS

(75) Inventors: Colin MacCallum, Hornby Island; Brian Robin Blackwell, Vancouver, both of (CA)

(73) Assignee: Boiler Island Air Systems Inc., Hornby Island (CA)

( * ) Notice: Subject to any disclaimer, the term of this patent is extended or adjusted under 35 U.S.C. 154(b) by 0 days.

(21) Appl. No.: 09/382,453

(22) Filed: Aug. 25, 1999

(51) Int. Cl.[7] ..... F23L 1/00; F23G 7/04

(52) U.S. Cl. ..... 110/348; 110/297; 110/343; 110/234; 110/238

(58) Field of Search ..... 110/238, 297, 110/343, 345, 346, 348, 234, 347; 431/175, 176, 180

(56) References Cited

U.S. PATENT DOCUMENTS

| | | | | |
|---|---|---|---|---|
| 3,215,099 | * | 11/1965 | Coulter | 110/7 |
| 3,403,642 | * | 10/1968 | Parkin | 110/7 |
| 3,413,936 | * | 12/1968 | Matthews | 110/7 |
| 3,421,462 | * | 1/1969 | Wessberg | 110/7 |
| 4,462,319 | * | 7/1984 | Larsen | 110/238 |
| 4,810,186 | * | 3/1989 | Rennert et al. | 431/175 |
| 4,940,004 | * | 7/1990 | Jansen | 110/182.5 |
| 5,007,354 | * | 4/1991 | Uppstu | 110/238 |
| 5,121,700 | * | 6/1992 | Blackwell et al. | 110/348 |
| 5,205,226 | * | 4/1993 | Kitto et al. | 110/264 |
| 5,305,698 | * | 4/1994 | Blackwell et al. | 110/348 |
| 5,450,803 | * | 9/1995 | Svensk et al. | 110/346 |
| 5,715,763 | * | 2/1998 | Fornetti et al. | 110/238 |
| 5,809,913 | * | 9/1998 | Kramer et al. | 110/347 |

* cited by examiner

*Primary Examiner*—Denise L. Ferensic
*Assistant Examiner*—K. B. Rinehart

(57) ABSTRACT

This invention improves fluid flow, gas mixing and combustion in the furnaces of recovery boilers which burn liquor from various pulping processes, namely, the kraft process, the soda process, the sodium-based sulphite process, the closed-cycle CTMP (chemical, thermal, mechanical pulp) process, the magnesium-based sulphite process and the ammonium-based sulphite process, which are employed in the manufacture of pulp and paper, and in the furnaces of boilers burning biomass, wood waste or other solid fuel. The invention improves the operation of new or retrofitted boilers in several ways and can reduce both the capital and operating costs.

One embodiment comprises introducing a portion of the combustion air, and/or recycled flue gas, at any elevation in the furnace, from two opposing walls only, as jets arranged in a partially-interlaced manner, with the jets oriented in a more or less common plane which is inclined.

The partially-interlaced jets can be applied as primary air to improve performance and reduce capital costs.

44 Claims, 11 Drawing Sheets

Lower Furnace; 3-dimensional; Partially-interlaced jets in flat, inclined plane, with jet direction parallel to incline

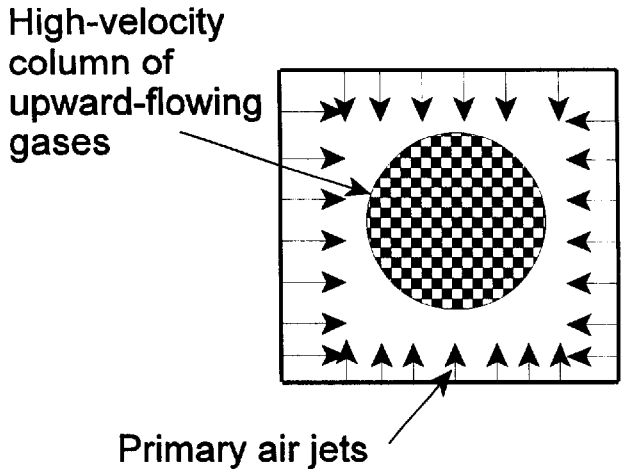
Fig.1 Furnace - Plan View; Four-wall primary air jets
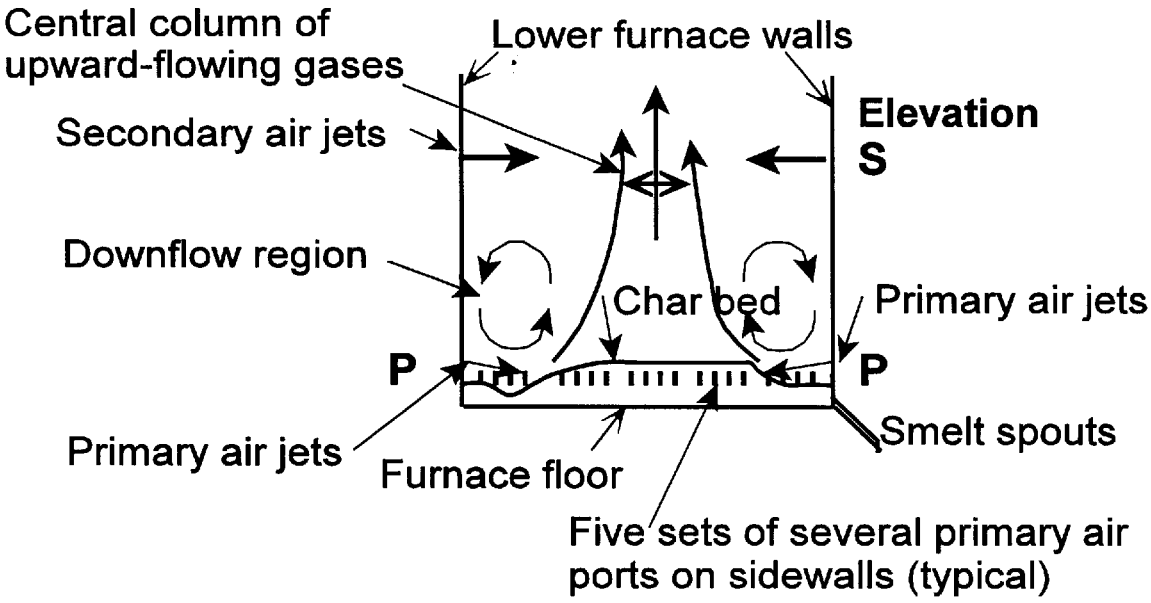
Fig.2 Flat-floor furnace - side view; Small primary air jets at 0-5 degrees downwards on all four walls

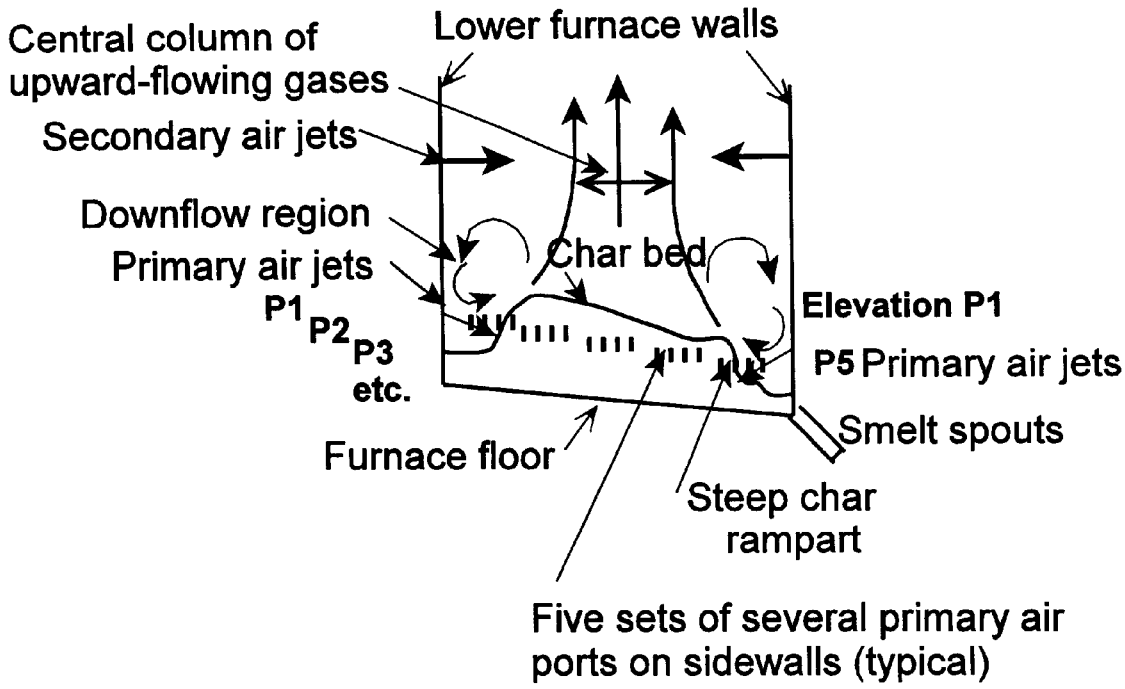
Fig.3 Sloping-floor furnace -side view; Small primary air jets at 30 degrees downwards on all four walls
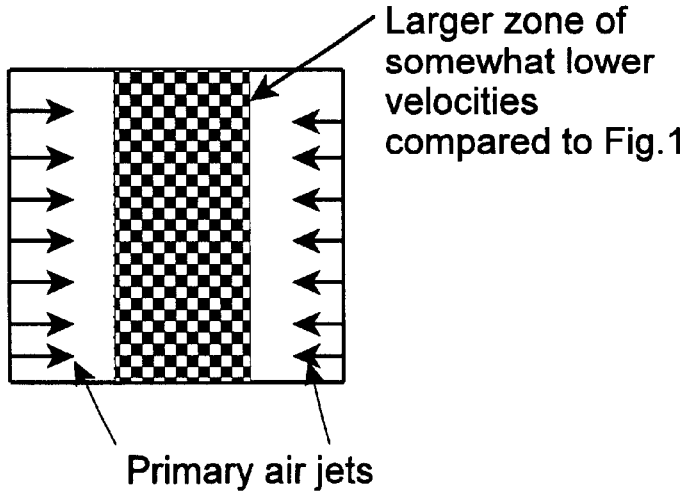
Fig.4 Furnace - Plan View; Two-wall primary air jets

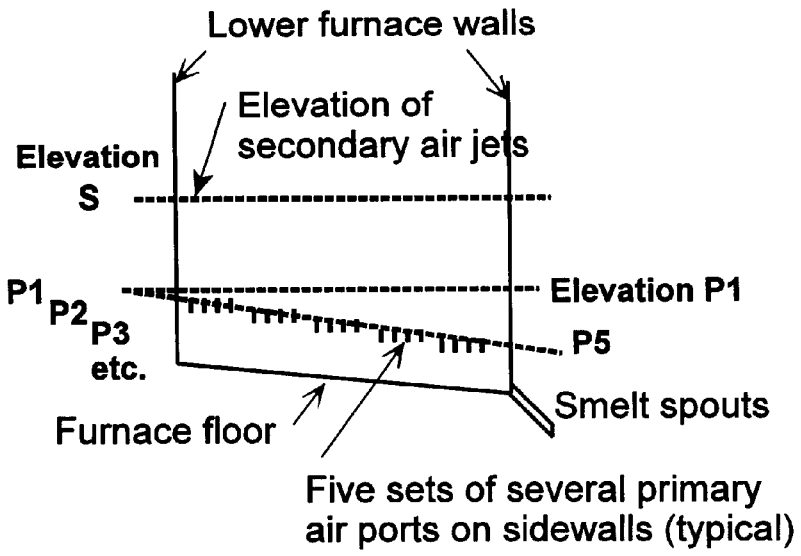
Fig.5 Sloping-floor furnace -side view; showing Horizontal Plane P1-P1 and Proposed Plane P1-P5 for two-wall primary air jets from front & rear walls or, alternatively, from sidewalls
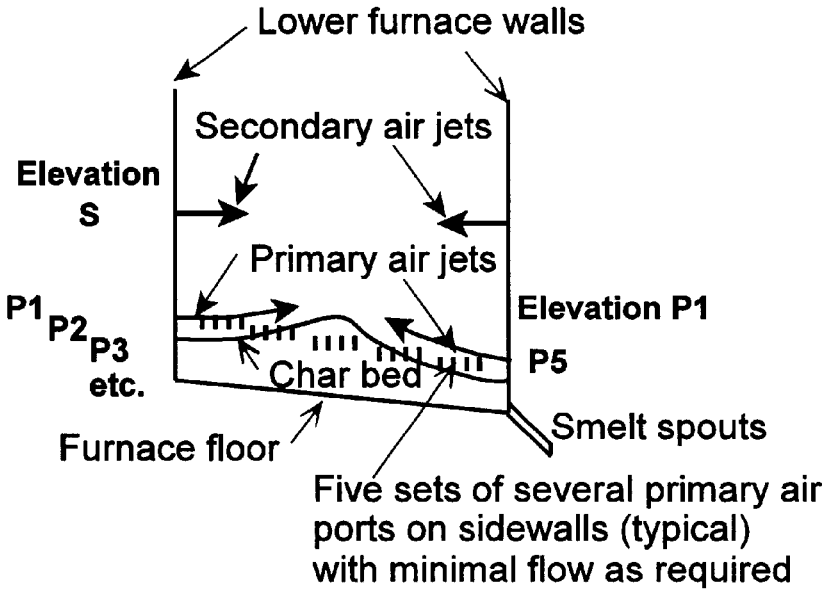
Fig.6 Sloping-floor furnace -side view; Proposed two-wall primary air jets from front & rear walls at Plane P1-P5

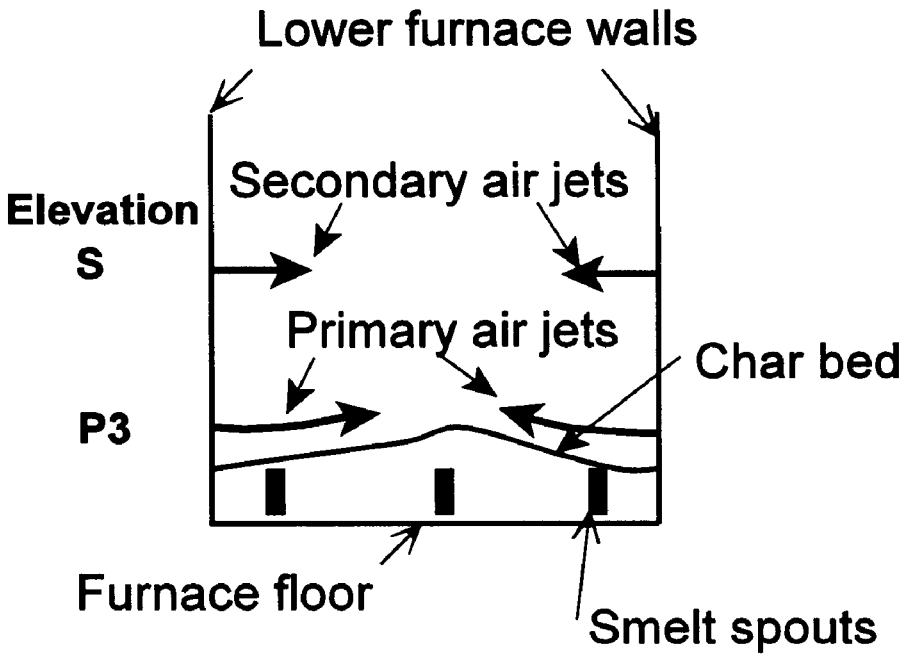
Fig.7 Sloping-floor furnace -front view; Proposed two-wall primary air jets from sidewalls (only P3 jets shown); Small front & rear jets (minimal flow as required) not shown

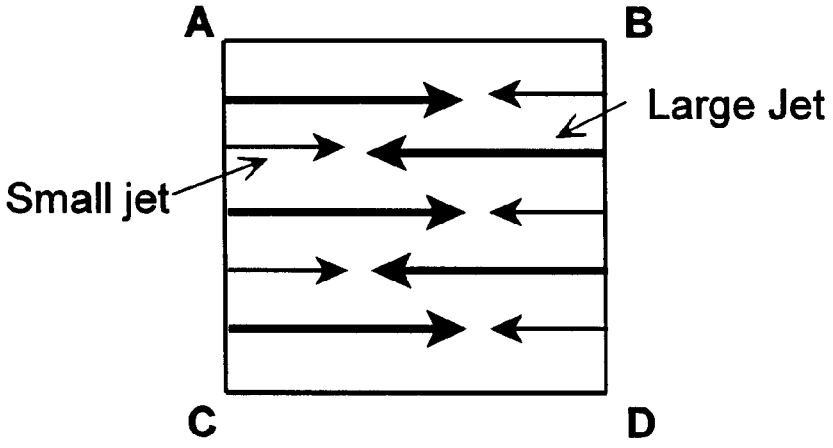
Fig.8 Furnace -Plan View; Partially-interlaced air jets from sidewalls, or from front and rear walls
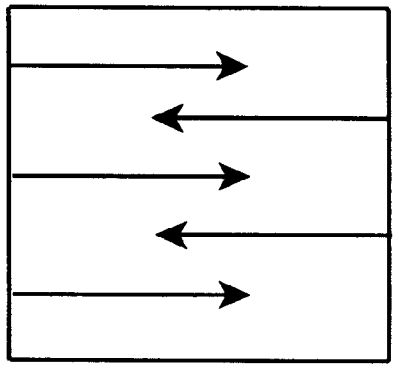
Fig.9 Furnace -Plan View; Fully-interlaced air jets from sidewalls, or from front and rear walls

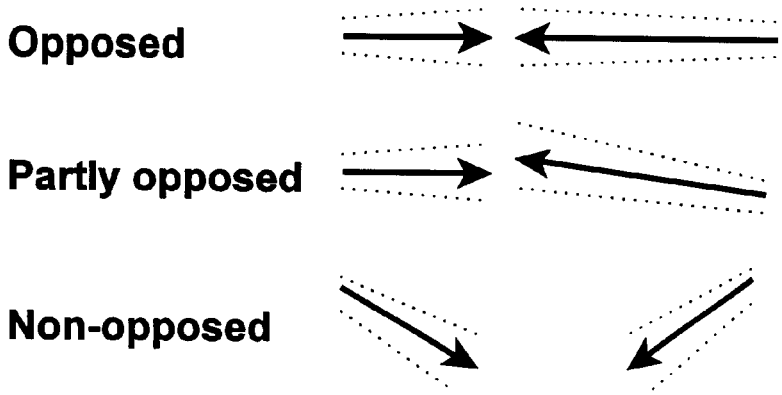
Fig.10 Juxtaposition of opposed, partly-opposed and non-opposed jets
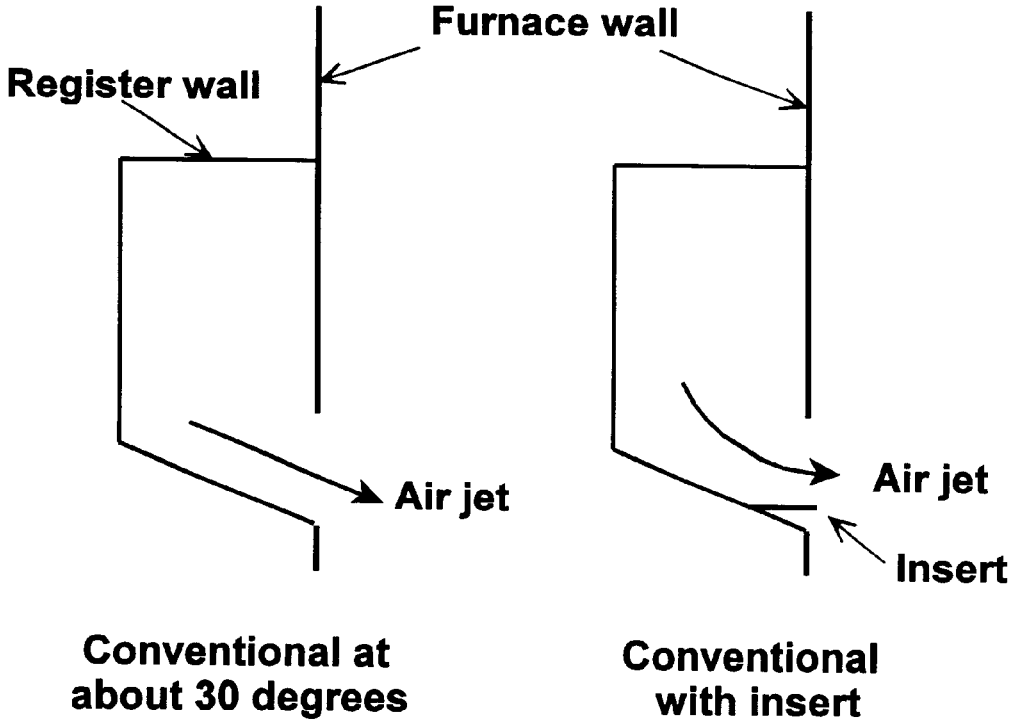
Fig.11 Sectional view of sloping-port registers; Conventional at about 30 degrees and with insert to give horizontal jet

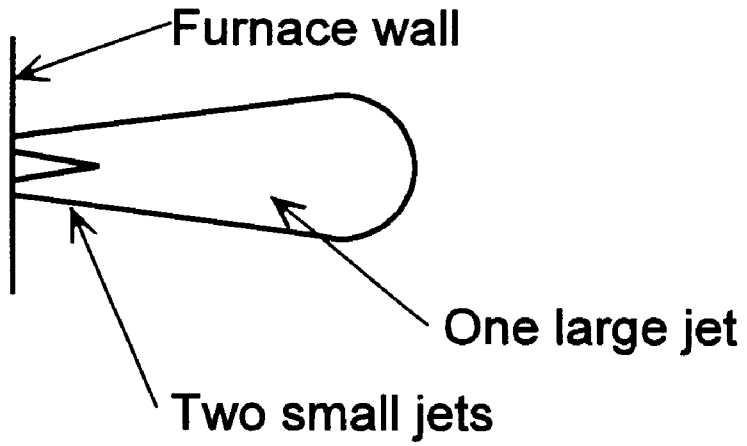
Fig.12 Schematic plan or elevation of register effect, namely, two or more air jets combining to form a single large jet

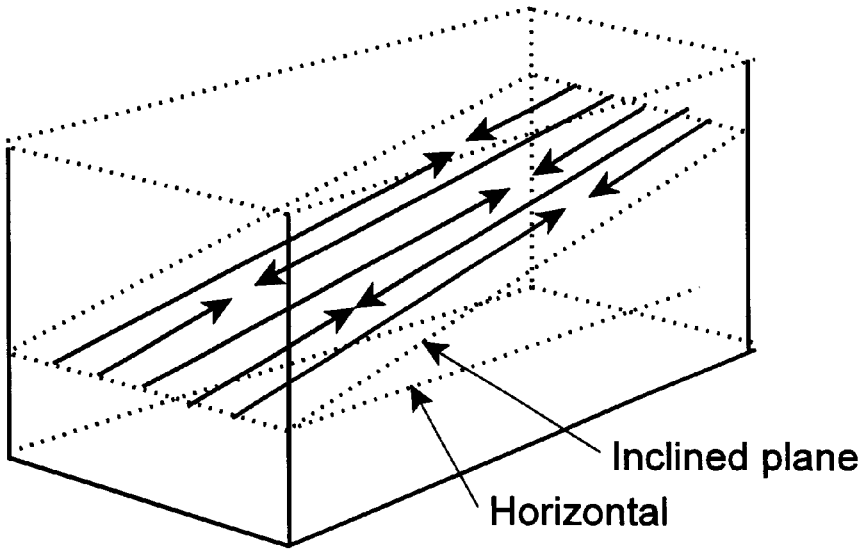
Fig.13 Lower Furnace; 3-dimensional;
Partially-interlaced jets
in flat, inclined plane,
with jet direction parallel to incline
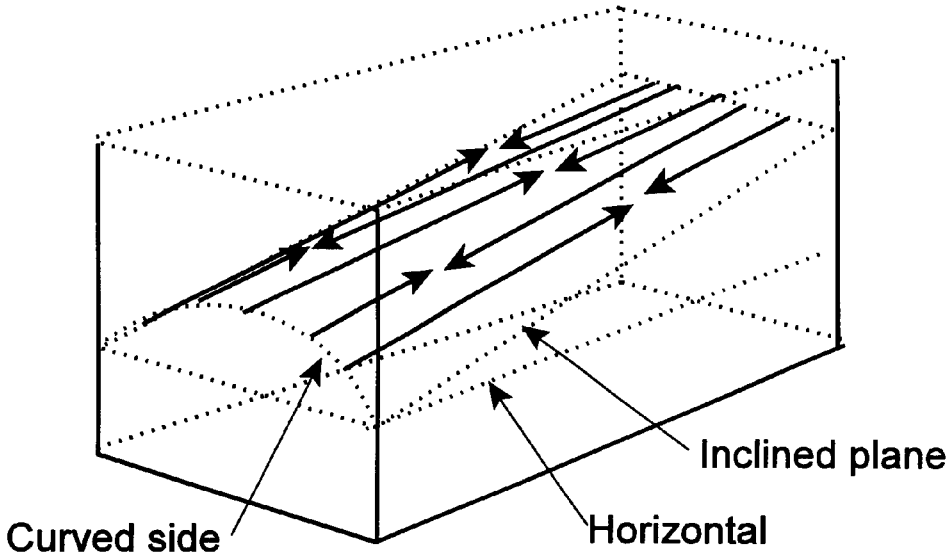
Fig.14 Lower Furnace; 3-dimensional;
Partially-interlaced jets
in inclined plane with one curved side,
with jet direction parallel to incline

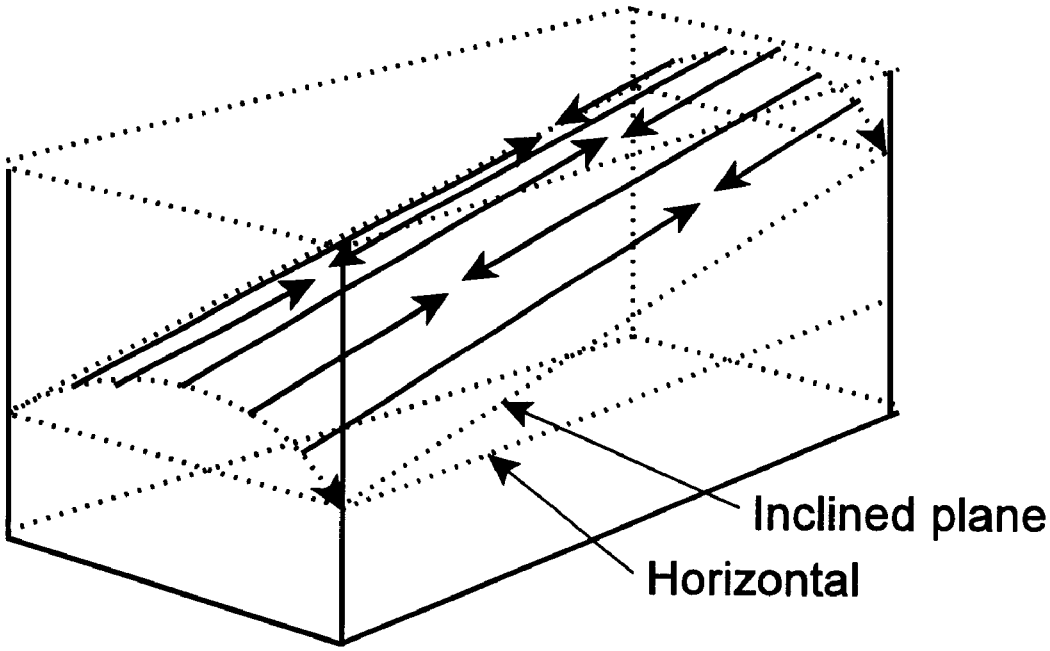
Fig.15 Lower Furnace; 3-dimensional;
Partially-interlaced jets
in inclined plane with two curved sides,
with jet direction parallel to incline

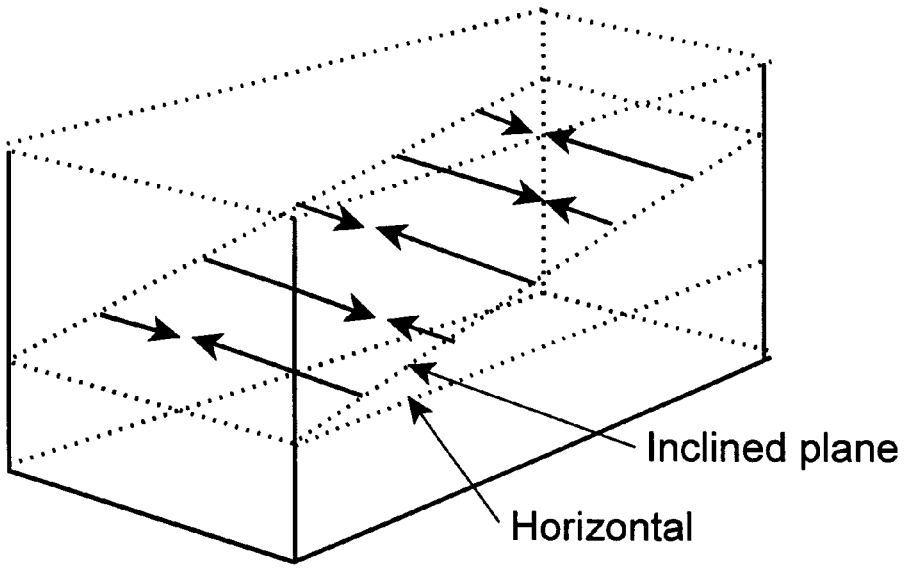
Fig.16 Lower Furnace; 3-dimensional;
Partially-interlaced jets
in flat, inclined plane,
with jet direction at right angles to incline
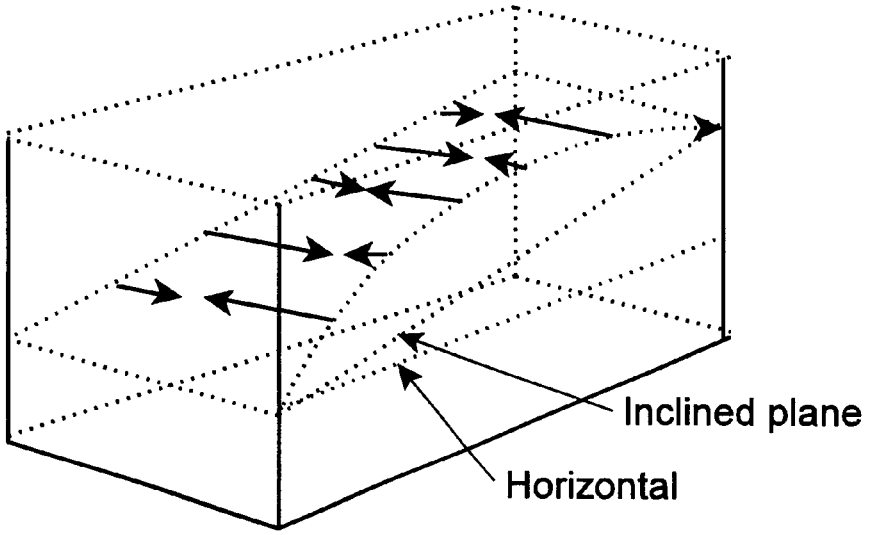
Fig.17 Lower Furnace; 3-dimensional;
Partially-interlaced jets
in inclined plane with one curved side
with jet direction at right angles to incline

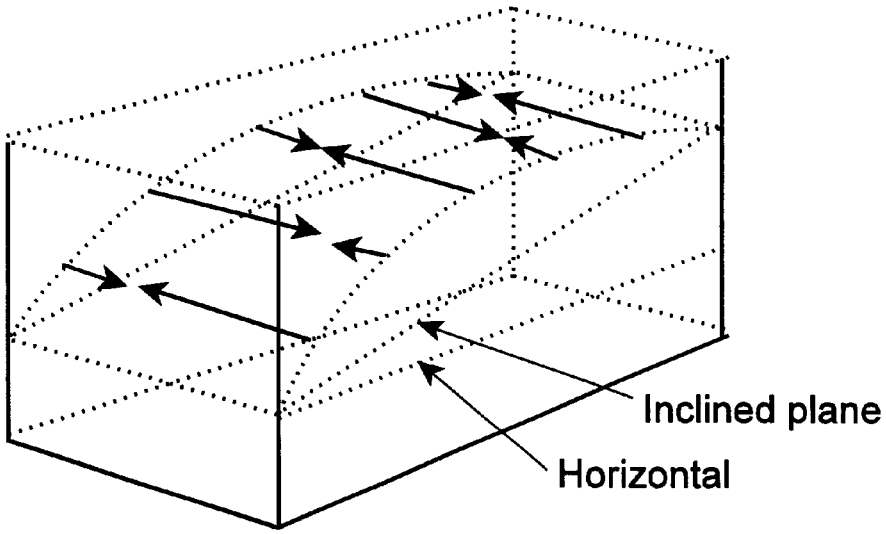
Fig.18 Lower Furnace; 3-dimensional;
Partially-interlaced jets
in inclined plane with two curved sides,
with jet direction at right angles to incline
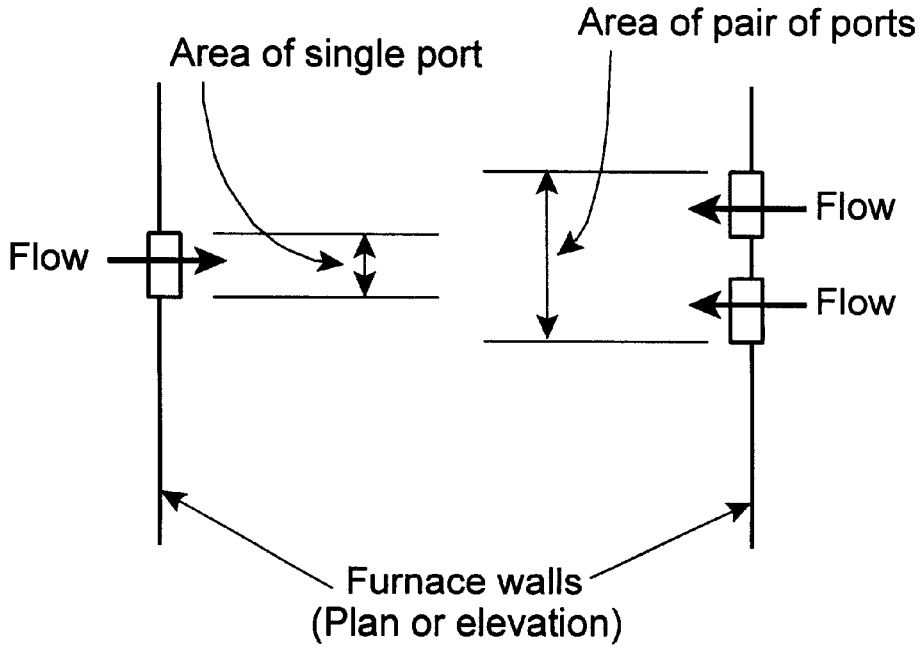
Fig.19 Lower Furnace, Part View Schematic;
All of the area of a single port
opposite the area of a pair of ports

METHOD AND APPARATUS FOR FURTHER IMPROVING FLUID FLOW AND GAS MIXING IN BOILERS

BACKGROUND OF THE INVENTION

This invention is directed to a method and apparatus for improving combustion and the operation of new or retrofitted boilers in various ways. The adoption of the proposed method and apparatus can be expected to reduce capital and operating costs. The types of boilers to which the invention applies are boilers burning biomass, wood waste or other solid fuel, and recovery boilers which burn waste liquor from various pulping processes which are employed in the manufacture of pulp and paper. These processes include: the kraft process, the soda process, the sodium-based sulphite process, the closed-cycle CTMP (chemical, thermal, mechanical pulp) process, the magnesium-based sulphite process and the ammonium-based sulphite process. These boilers generate steam for various process requirements.

All these boilers require combustion air and generally have furnaces which are rectangular in horizontal cross-section.

Ineffective combustion air systems result in poor mixing of the combustion air with the combustibles in the furnace. Poor mixing causes inefficient combustion, which can lead to excessive fouling of the heating surfaces, excessive erosion of the boiler tubes and overloading of the electrostatic precipitator. In certain recovery boilers, inefficient combustion also causes excessive emissions of TRS (total reduced sulphur), carbon monoxide and fume, unnecessarily low smelt-reduction efficiencies and may cause problems with char-bed control and smelt run-off. The manner in which the combustion air is introduced at the various elevations in the furnace may generate excessive fume.

Ineffective combustion air systems may also create a central column of rapidly-upward-flowing flue gases which entrains particulate and, in recovery boilers, liquor droplets and particulate, and carries this material out of the furnace. This carryover material can cause fouling of the heating surfaces and overloading of ash hoppers.

Ineffective combustion air systems may have air jets which fail to penetrate sufficiently far into the furnace, thus starving the centre of the furnace of oxygen. Alternatively, the air jets may be too strong and impinge on the opposite furnace wall, causing circulation problems and/or tube damage. Some combustion air systems suffer lack of jet penetration and/or excessive jet penetration when operated at loads other than the design load.

In boilers burning biomass, wood waste or other solid fuel, the fuel is generally burned on a grate, or in a fluidized bed. The combustion air is introduced both undergrate and through multiple air ports in the furnace walls. In this type of boiler, the air introduced through the wall ports is often termed overfire air, but the various air zones may be given the same terminology as the air zones in recovery boilers, as described below.

In recovery boilers firing liquor from the magnesium-based sulphite process, and the ammonium-based sulphite process, most of the combustion air is introduced as so-called primary air through liquor burners located in the walls or roof of the furnace while the remainder of the combustion air is introduced through multiple air ports in the furnace walls. These multiple air ports may be arranged in several zones, or sub-systems of ports, and may be named, successively, from the burner region towards the outlet of the furnace, secondary air and tertiary air, etc. The multiple ports of each air zone may be on one or more walls of the furnace.

In recovery boilers firing liquor from the kraft process, the soda process, the sodium-based sulphite process, and the closed-cycle CTMP process, all the combustion air is introduced through multiple air ports in the furnace walls. The air ports in these recovery boilers, and the air ports in the walls of boilers burning biomass, wood waste or other solid fuel, are arranged in several zones, or sub-systems of ports, named, successively, from the furnace floor elevation, upwards: primary air, secondary air and tertiary air, etc. The ports of each air zone may be on one or more walls of the furnace.

In recovery boilers which fire waste liquor from the kraft process, the soda process, the sodium-based sulphite process, and the closed-cycle CTMP process, conventionally, the primary air is introduced through multiple ports in four walls, such that the quantity of air originating from each wall is approximately the same and the flow through all the individual ports is more or less equal. The primary air jets from these ports on each wall collide with and interfere with the air jets from adjacent walls and are deflected upwards, thus creating the above-mentioned central column of rapidly-upward-flowing flue gases which causes particulate entrainment, fouling, etc. In a similar manner, the other air zones of the boiler can create or reinforce the central column of rapidly-upward-flowing flue gas, or create other regions of unnecessarily high upward velocities , which carry liquor droplets and other particulate out of the furnace.

By employing the proposed method and apparatus, upward velocity extremes are minimized, and gas mixing and combustion are improved. In certain cases, the number of air ports may be reduced. Thus, the operating and capital costs of the installation can be reduced.

PRIOR ART

By way of exemplification and not limitation, several examples of prior art forms of two-wall primary air-jet arrangements and of partially-interlaced air-jet arrangements are described in the following paragraphs. None of these examples presents the concepts embodied in the proposed invention.

The following patents, all entitled "Method and apparatus for improving fluid flow and gas mixing in boilers", describe a method and apparatus also invented by Blackwell and MacCallum, wherein the primary air in a recovery boiler is introduced substantially from two walls only, and a related method and apparatus in which combustion air is introduced in a partially-interlaced manner:

U.S. Pat. No. 5,121,700: Issue date Jun. 16, 1992

U.S. Pat. No. 5,305,698: Issue date Apr. 26, 1994

Canadian Patent No. 1,308,964: Ser. No. 564,320; Issue date Oct. 20, 1992

Canadian Patent No. 1,324,537; Ser. No. 616,260; Issue date Nov. 23, 1993.

U.S. Pat. No. 5,121,700 describes partial-interlacing of the primary air jets from a first and a second opposing wall, with substantially no air from a third and a fourth opposing wall, partial-interlacing of the secondary air jets with substantially no air from the third and fourth walls, and partially-interlaced secondary air in combination with two-wall primary air which is created by large jets from two opposing walls and essentially no air from the remaining two walls.

U.S. Pat. No. 5,305,698 describes particular arrangements of two-wall primary air in which a small quantity of air is introduced from the third wall, alternatively from the third and fourth walls. This patent also describes secondary air introduced mostly from two opposing walls with somewhat less air, or substantially no air, being introduced from the third and fourth walls at the same secondary elevation, in combination with the afore-mentioned (in this paragraph) two-wall primary air arrangements.

Canadian Patent No. 1,308,964 describes partially-interlaced air jets.

Canadian Patent 1,324,537 describes a secondary air-jet arrangement with the secondary air introduced from two walls only, in combination with a particular arrangement of two-wall primary air in which there are large primary air jets on two opposing walls and small jets on the third and fourth walls.

In all of these patents, the two-wall primary air jets are from air ports which are all at substantially the same, first, elevation while the partially-interlaced air jets of, for example the secondary elevation, are from air ports, all essentially at a common, second, elevation higher than the primary elevation. None of these patents describes the method or apparatus of the proposed invention in which the combustion air at either the primary or secondary elevations, or at any elevation, is introduced in the proposed manner from air ports located along the sides of an inclined plane or a skewed plane.

The proposed method and apparatus are improvements to the above-mentioned patents.

A technical paper "Novel air systems for kraft recovery boilers", by Colin MacCallum, presented at a meeting of the Black Liquor Recovery Boiler Advisory Committee (BLRBAC) in Atlanta, Ga., on Oct. 6, 1993, describes a three-month trial with two-wall primary air conducted on a sloping-floor boiler at Mackenzie, BC, Canada. In the trial, the boiler was operated with steeply-sloping primary air jets from the front and rear walls, that is, the walls at the upper and lower ends of the sloping floor, with a small quantity of air leaking through steeply-sloping primary air ports on the two inactive sidewalls. The paper proposed directing the air horizontally from the two active front and rear walls by installing either new air ports or by installing inserts in the existing primary air ports. The paper did not disclose directing the air in an inclined plane, for example essentially parallel to the sloping floor, as opposed jets, from the front and rear walls by installing either new air ports or by installing inserts in the existing primary air ports. The paper also did not disclose directing the air in an inclined plane, for example essentially parallel to the sloping floor, as opposing jets, from the sidewalls.

There is a wood-waste-fired boiler in Washington state, USA, in which the tertiary air ports were essentially fully-opposed and equally-spaced across the width of the front and rear walls of the furnace. Further, the front wall ports were at an elevation somewhat higher than the ports of the rear wall. In June 1997, MacCallum recommended, to the owner and to the boiler manufacturer only, that a partially-interlaced tertiary air-jet arrangement be installed and, to take advantage of the existing air ports, suggested that selected air ports be dampered to provide the desired partially-interlaced arrangement of jets on the sloping plane formed by the front and rear wall ports. The modified boiler started up in October 1997. There has been no public disclosure of this feature.

At Tasman Pulp and Paper Limited, in New Zealand, the principle of the two-wall primary-air-jet arrangement was suggested by the inventors as an improvement to a very old boiler, which originally started up in 1955 and, after a period of operation with the primary air shut off from two opposing walls, was rebuilt with a two-wall arrangement around 1994. The boiler continues to operate well. With the two-wall primary-air mode of operation, the TRS emissions are significantly lower, and the reduction efficiencies are significantly higher, than they were with the original four-wall mode of operation. The furnace has a flat floor and all the primary air ports are at the same elevation. The primary air ports are angled downwards at 25 degrees, so the jets are not horizontal, not opposed or partly opposed, nor parallel to the floor.

SUMMARY OF THE INVENTION

Good mixing of the combustion air and combustible flue gases in a recovery furnace firing liquor from the kraft process, the soda process, the sodium-based sulphite process, and the closed-cycle CTMP process, as well as minimal entrainment of particulate and liquor droplets in the flue gases in such furnaces, can be achieved with the method and apparatus of the invention. Similarly, minimal particulate entrainment in the flue gases of a furnace fired with red liquor from the magnesium-based sulphite process, or a furnace fired with red liquor from the ammonium-based sulphite process, or a furnace fired with biomass, wood waste or other solid fuel can be achieved with the method and apparatus of the invention.

The first embodiment of the invention pertains to a recovery boiler furnace firing black liquor from the kraft process, a recovery boiler furnace firing black liquor from the soda process, a recovery boiler furnace firing black liquor from the sodium-based sulphite process, a recovery boiler furnace firing black liquor from the closed-cycle CTMP process, a recovery boiler furnace firing liquor from the magnesium-based sulphite process, a recovery boiler furnace firing liquor from the ammonium-based sulphite process, and boiler furnaces burning biomass, wood waste or other solid fuel, which utilize injected air or flue gas, and comprises a method of introducing a portion of the combustion air, or some portion of recycled flue gas in place of all or some of the said portion of the combustion air, at any elevation into the furnace, such that most or all of the air, and/or recycled flue gas being introduced at the particular elevation is introduced from air ports located essentially along two opposing, so-called "active" sides of a non-horizontal plane. This plane can be flat, or curved. The plane can be inclined in the direction of the jet flow, inclined at right angles to the direction of the jet flow, skewed, or essentially parallel to the floor in a sloping-floor furnace. The air jets from these ports on the "active" walls are arranged in a partially-interlaced pattern of large and small air jets. That is, the total air flow from each of the two "active" sides of the plane is more or less equal; each large jet is opposed by a small jet originating from the opposite wall; the large and small jets alternate on each active wall, i.e. they are arranged small/large/small/large, etc. across the width, or depth of the furnace on each active wall. The pattern may be symmetrical, but need not be symmetrical. The air jets may be directed in the plane, or directed slightly downwards, or slightly upwards from the inclined or skewed plane, or slightly left in the plane, or slightly right in the plane, such that the jets in each opposing pair may be fully opposed or partly opposed, as shown in FIG. 10. The remaining small quantity of air, or no air, is introduced from air ports on the remaining two opposing, so-called "inactive" sides of the said plane. Alternatively, the remaining small quantity of air and recycled flue gas, or no air and no recycled flue gas, is introduced from air ports on the remaining two opposing, so-called "inactive" sides of the said plane. Where all the air, or all the air and recycled flue gas, is introduced through ports on the "active" sides of the plane, there need be no ports on the "inactive" sides of the plane.

In the method, there are many ways of creating the large and small jets featured in the partially-interlaced pattern:

- the small and large jets can originate from corresponding small and large ports
- each small jet can originate from a group or cluster of small ports and each large jet can originate from a group or cluster of large ports
- each small jet can originate from a group or cluster of ports and each large jet can originate from a larger group or cluster of similarly sized ports. For example, each small jet can originate from a single port and each large jet can originate from a pair of similarly sized ports. Some or all of the area of the single port can be substantially opposite to at least some of the area defined by the pair of ports. Some or all of the area of the single port can be opposite the area defined by the pair of ports.
- the ports can be of similar size and number and the large jets can be created by a higher air pressure than the pressure creating the small jets.

In recovery boilers, the first embodiment of the method improves combustion and increases thermal efficiencies and, in specific cases, decreases TRS and/or carbon monoxide emissions and reduces fume generation and, also, minimizes the extremes of upward gas velocity, which, in turn, minimizes the carryover of particulate such as liquor droplets and fuel particles, minimizes the build-up of deposits of unburned liquor and/or some of the products of combustion on the heating surfaces of the boilers, and reduces erosion of the tubular heating surfaces.

In boilers burning biomass, wood waste or other solid fuel, the first embodiment of the method improves combustion and increases thermal efficiencies, and also minimizes the carryover of particulate such as fuel particles and ash, which, in turn, reduces erosion of the tubular heating surfaces.

In recovery boilers and in boilers burning biomass, wood waste or other solid fuel, in the first embodiment of the method, the small jets prevent the opposing large jets from impinging on the opposite wall of the furnace.

The second embodiment of the invention pertains to a recovery boiler furnace firing black liquor from the kraft process, a recovery boiler furnace firing black liquor from the soda process, a recovery boiler furnace firing black liquor from the sodium-based sulphite process, and a recovery furnace firing black liquor from the closed-cycle CTMP process, and which utilize injected air, and comprises a method of introducing the primary air at the lowest air zone into the furnace, such that at least 80 percent of the primary air is introduced, more or less equally, in jets from the air ports on two opposing, first and second, so-called "active" walls, and, where applicable, that is, in all but the 100 percent case, the remainder of the air being introduced, more or less equally, from the remaining two opposing, third and fourth, so-called "inactive" walls, where all the air ports are located essentially along the sides of a non-horizontal plane. Where all the primary air is introduced through ports on the "active" sides of the plane, there need be no ports on the "inactive" sides of the plane. This plane can be flat, or curved. The plane can be inclined in the direction of the jet flow, inclined at right angles to the direction of the jet flow, skewed, or essentially parallel to the floor in a sloping-floor furnace. The jets in each pair of opposite, active walls may be fully opposed or partly opposed as shown in FIG. 10, while the jets in each pair of opposite, inactive walls may be fully opposed, or partly opposed, or non-opposed as shown in FIG. 10. That is, the larger air jets from the active walls are directed more or less in the plane, or slightly downwards, or slightly upwards, or slightly left in the plane, or slightly right in the plane, while the smaller air jets from the inactive walls may be steeply sloping downwards, or directed more or less in the plane, or slightly downwards, or slightly upwards, or slightly left in the plane, or slightly right in the plane. The jets from one of the active walls may be the same size as the jets from the opposite wall, but may be somewhat smaller than the jets from the opposite wall.

The second embodiment of the method improves combustion as noted, increases smelt-reduction efficiencies, decreases TRS emissions, and increases thermal efficiencies and, in some cases, reduces carbon monoxide emissions and fume generation. The second embodiment of the method creates distinct down-flow regions in the furnace, into which regions the liquor droplets may be preferentially sprayed. The second embodiment also improves char-bed control, minimizes the carryover of particulate such as liquor droplets and fuel particles, which, in turn, minimizes the build-up of deposits of unburned liquor and/or some of the products of combustion on the heating surfaces of the boilers, and reduces erosion of the tubular heating surfaces. The second embodiment is expected to reduce tube-wall metal temperatures and, depending on the metallurgy of the wall tubes, may reduce attendant metal wastage in the lower furnace.

In the second embodiment, the higher velocity of air passing through the ports of two of the opposing furnace walls helps to keep the ports clean, thus minimizing port-rodding requirements.

The second embodiment can essentially halve the number of air ports at the primary elevation, since there need be air ports on two opposite walls only; thus, the capital costs can be lower than the costs for a conventional four-wall arrangement. When the partially-interlaced jets of the first embodiment are applied at the primary elevation as a combination of the first and second embodiments, then the number of air ports is further reduced.

The methods and apparatus can be applied to new or retrofitted boilers as follows:

- a recovery boiler furnace firing black liquor from the kraft process, a recovery boiler furnace firing black liquor from the soda process, a recovery boiler furnace firing black liquor from the sodium-based sulphite process, a recovery boiler furnace firing black liquor from the closed-cycle CTMP process, a recovery boiler furnace firing liquor from the magnesium-based sulphite process, a recovery boiler furnace firing liquor from the ammonium-based sulphite process, and boiler furnaces burning biomass, wood waste or other solid fuel, which utilize injected air or flue gas, and comprising an arrangement of air ports for introducing the combustion air or some portion of recycled flue gas in place of all, or some of the said portion of the combustion air, at any elevation into the furnace, such that most or all of the air and/or flue gas introduced at the particular elevation is introduced from air ports located essentially along two so-called "active" opposite sides of a plane which is not horizontal. This plane can be flat, or curved. The plane can be inclined in the direction of the jet flow, inclined at right angles to the direction of the jet flow, skewed, or essentially parallel to the floor in a sloping-floor furnace. The air jets from these ports on the "active" sides of the plane are arranged in a partially-interlaced pattern of large and small air jets. That is, the total air flow from each of the two "active" sides of the plane is more or less equal; each large jet is opposed by a small jet originating from the opposite wall; the large and small jets alternate on each active wall, i.e. they are arranged small/large/small/large, etc. across the width, or depth of the furnace on each active wall. The pattern may be symmetrical, but need not be symmetrical. The air jets in each opposing pair may be fully opposed or partly opposed, that is, they may be directed in the said plane, or directed slightly downwards, or slightly upwards from the said plane, or slightly left in the plane, or slightly right in the plane. Ports may be located on the other two opposing, so-called "inactive" sides of the plane, through which the remaining small quantity of air, or no air, is introduced. Alternatively, ports may be located on the other two opposing, so-called "inactive" sides of the plane, through which the remaining small quantity of air and recycled flue gas, or no air and no recycled flue gas, is introduced. Where all the air, or all the air and recycled flue gas, is introduced through ports on the "active" sides of the plane, there need be no ports on the "inactive" sides of the plane.

A recovery boiler furnace firing black liquor from the kraft process, a recovery boiler furnace firing black liquor from the soda process, a recovery boiler furnace firing black liquor from the sodium-based sulphite process, and a recovery furnace firing black liquor from the closed-cycle CTMP process, and which utilize injected air, comprising a set of primary air ports at the lowest air zone in the furnace, where at least 80 percent of the primary air is introduced, more or less equally, from the air ports on two opposing, so-called "active" walls, the remainder of the air being introduced, more or less equally, from the remaining two opposing, so-called "inactive" walls, where the air ports are located essentially along the sides of a non-horizontal plane. Where all the primary air is introduced through ports on the "active" sides of the plane, there need be no ports on the "inactive" sides of the plane. This plane can be flat, or curved. The plane can be inclined in the direction of the jet flow, inclined at right angles to the direction of the jet flow, skewed, or essentially parallel to the floor in a sloping-floor furnace. The jets in each pair of opposite, active walls may be fully opposed or partly opposed as shown in FIG. 10, while the jets in each pair of opposite, inactive walls may be fully opposed, or partly opposed, or non-opposed as shown in FIG. 10. That is, the larger airjets from the active walls are directed more or less in the plane, or slightly downwards, or slightly upwards, or slightly left in the plane, or slightly right in the plane, while the smaller air jets from the inactive walls may be steeply sloping downwards, or directed more or less in the plane, or slightly downwards, or slightly upwards, or slightly left in the plane, or slightly right in the plane.

In the furnace, there are many ways of arranging the air ports in order to create the large and small jets featured in the partially-interlaced pattern of the first embodiment:

small ports can be used to create the small jets and large ports can be used to create the large jets groups or clusters of small ports can be used to create each small jet, while groups or clusters of large ports can be used to create each large jet groups or clusters of small ports can be used to create each small jet, while larger groups or clusters of similarly sized ports can be used to create each large jet. For example, each small jet can originate from a single port and each large jet can originate from a pair of similarly sized ports. Some or all of the area of the single port can be substantially opposite to at least some of the area defined by the pair of ports. Some or all of the area of the single port can be opposite the area defined by the pair of ports.

the ports can be of similar size and number and the large jets can be created by a higher air pressure than the pressure creating the small jets.

BRIEF DESCRIPTION OF THE SEVERAL DRAWINGS

The following drawings illustrate specific embodiments of the invention, but should not be construed as restricting the spirit or scope of the invention in any way:

FIG. 1 is a schematic cross-sectional plan view of a typical furnace showing the primary air jets being admitted from all four walls and also showing the cross-sectional area occupied by the central column of rapidly-upward-flowing gases.

FIG. 2 is a schematic sectional side elevation of a typical recovery furnace with a flat floor and indicates the location of the primary air jets which are directed at 0–5 degrees downwards from the horizontal on all four walls. The typical profile of the char bed is indicated. Further, the central chimney of rapidly-upward-flowing gases, and the down-flow regions associated with the primary air jets, are illustrated.

FIG. 3 is a schematic sectional side elevation of a typical recovery furnace with a sloping floor and indicates the location of the primary air jets which are directed at approximately 30 degrees downwards from the horizontal on all four walls. The typical profile of the char bed with its steep char rampart is indicated. The various typical elevations of the various air registers on the sidewalls are shown. Further, the central chimney of rapidly-upward-flowing gases, and the down-flow regions associated with the primary air jets, are illustrated.

FIG. 4 is a schematic cross-sectional plan view of a typical recovery furnace and indicates the location of the rectangular region of upward-flowing gases created by a two-wall primary air arrangement.

FIG. 5 is a schematic sectional side elevation of a typical recovery furnace with a sloping floor and indicates the horizontal plane P1-P1. It also shows the Plane P1-P5, from the sides of which the large primary air jets would be directed in the proposed method, in one manner, from the wall opposite the spout wall at elevation P1 and from the spout wall at elevation P5; or alternatively, in another manner, from the sidewall registers along the sloping sides of the plane P1-P5.

FIG. 6 is a schematic sectional side elevation of a typical recovery furnace with a sloping floor and indicates the large primary air jets proposed in the method, directed from the wall opposite the spout wall (the rear wall) at elevation P1 and from the spout wall (the front wall) at elevation P5. The sculpted profile of the char bed with its central ridge, typical of two-wall primary air operation, is indicated.

FIG. 7 is a schematic sectional elevation of a typical recovery furnace with a sloping floor, where the section is taken through both sidewall registers at Elevation P3, looking towards the smelt-spout wall. The diagram indicates the large primary air jets proposed in the method, directed from the sidewall registers at elevation P3. The corresponding large jets trom the other sidewall registers are not shown. The location of the smelt spouts on the front (or rear) wall is indicated. The sculpted profile of the char bed with its central ridge, typical of two-wall primary air operation, is indicated.

FIG. 8 is a schematic cross-sectional plan view of a typical furnace showing partially-interlaced air jets being admitted from any two opposing walls.

FIG. 9 is a schematic cross-sectional plan view of a typical furnace showing fully-interlaced air jets being admitted from any two opposing walls.

FIG. 10 shows the juxtaposition, for example in plan view and/or elevation, of pairs of air jets that are opposed, partly-opposed, and non-opposed.

FIG. 11 is a schematic sectional side elevation of a typical port register in a recovery furnace with a sloping floor, indicating, on the left of the figure, the conventional design with the air jet issuing at approximately 30 degrees downwards from the horizontal and, on the right of the figure, the same register with an insert at the port opening to deflect the jet towards the horizontal.

FIG. 12 is a schematic plan or elevation of the register effect, indicating the combining of two jets from a pair of ports to form a single larger jet.

FIG. 13 is a schematic three-dimensional biew of the lower portion of a typical furnace showing partially-interlaced air jets in a flat, inclined plane, the jets being admitted from two opposing walls, with the jet direction parallel to the incline of the plane.

FIG. 14 is a schematic three-dimensional view of the lower portion of a typical furnace showing partially-interlaced air jets in an inclined plane having on curved side, the fets being admitted from two opposing walls, with the jet direction parallel to the incline of the plane.

FIG. 15 is a schematic-dimensional view of the lower portion of a typical furnace showing partially-interlaced air jets in an inclined plane having two curved sides, the jets being admitted from two opposing walls, with the jet direction parrallel to the incline of the plane.

FIG. 16 is a schematic three-dimensional view of the lower portion of a typical furnace showing partially-interfaced air jets in a flat, inclined plane, the jets being admitted from two opposing walls, with the jet direction at right angles to the incline of the plane.

FIG. 17 is a schematic three-dimensional view of the lower portion of a typical furnace showing partially-interfaced air jets in an inclined plane having on curved side, the jets being admitted from two opposing walls, with the direction at right angles to the incline of the plane.

FIG. 18 is a schematic three-dimensional view of the lower portion of a typical furnace showing partially-interlaced air jets in an inclined plane having two curved sides, the jets being admitted from two opposing walls, with the jet direction at right angles to the incline of the plane.

FIG. 19 is a schematic part view of the lower portion of two opposing walls of a typical furnace, in plan or in elevation, showing a single port in one wall and a pair of ports in the opposite wall, with all of the area of the single port opposite the area of the pair of ports.

DETAILED DESCRIPTION OF THE INVENTION

Boilers are widely used to generate steam for numerous applications. All boilers which burn fuel (other than nuclear fuel) require combustion air. The combustion air is introduced into the furnace and, because the mixing of the combustion air and the fuel is imperfect, an air quantity in excess of the theoretical amount is required. The combustion air quantity which is employed in excess of the theoretical amount of air is termed "excess air". The theoretical combustion air and the excess air are admitted to the boiler system at ambient temperature and the excess air is exhausted to atmosphere with the other flue gases, at the temperature of the flue gases leaving the stack. Excess air thus reduces the thermal efficiency of boilers. One of the advantages of the proposed method is that the mixing of combustion air and combustibles in the furnace is improved and thus, the excess air quantity may be reduced, thus the thermal efficiency of the boiler is increased.

Generally, the walls and, often, the floor of the furnaces in modern boilers consist of water-cooled tubes, with the water on the inside of the tubes. Adjacent furnace tubes are fully-welded together along their lengths to form a gas-tight envelope which contains the furnace gases.

The waste liquor produced in a pulp-making process is called black liquor in the kraft process, in the soda process, in the sodium-based sulphite process and in the CTMP process. In the soda process, the liquor may also be called soda liquor. In the magnesium-based and ammonium-based sulphite processes, the liquor is called red liquor.

The liquor from these pulping processes consists of a mixture of the spent chemicals from the pulping processes, and water; some of the spent chemicals are dissolved, but some are present in colloidal and particulate form.

The recovery boilers, in burning the liquor, dispose of the liquor and, in most cases, the inorganic materials resulting from the combustion are recovered to regenerate the pulping chemicals. A prime function of a recovery boiler is to convert oxidised sulphur compounds such as, $Na_2SO_4$, $Na_2SO_3$, and $Na_2S_2O_3$, to the reduced form $Na_2S$, which is an active component of the so-called white liquor which is used in the actual pulping process. The reduction efficiency of a recovery boiler is a measure of its ability to convert these oxidised sulphur compounds to $Na_2S$.

Red Liquor Recovery Boilers

In recovery boilers firing red liquor from the magnesium-based sulphite process, and the ammonium-based sulphite process, the liquor is atomized using steam or compressed air and fired in liquor burners located in the walls or roof of the furnace.

Black Liquor Recovery Boilers

In recovery boilers which fire black liquor from the kraft process, the sodium-based sulphite process, and the closed-cycle CTMP process, the liquor is introduced, without atomization, as a spray from one or more liquor nozzles, or liquor guns, which are inserted through openings in the walls of the furnace, generally at a common elevation some 4 to 5 m above the furnace floor. The furnace height, from furnace floor to furnace roof, may be 10 to 40 or 50 m, depending on the capacity of the boiler. In the soda process, steam or air atomization of the liquor is employed.

When the black liquor is sprayed into the hot furnace, some in-flight drying of the droplets occurs, and some of the volatile combustible components vaporize. Most or all of these volatiles burn in the furnace. Small, light droplets may be carried upwards by the rising gaseous products of combustion. In the kraft process, the sodium-based sulphite process, and the closed-cycle CTMP process, large, heavy droplets fall to the bottom of the furnace and form a bed of char where the combustion reactions continue.

Molten smelt, together with imperfectly combusted solid materials including carbon char particles and unburned liquor, percolates through this char bed. In cases where the black liquor droplets are sprayed on to the walls, the smelt also runs down the walls of the furnace. The molten smelt is extremely corrosive; therefore the walls of the lower furnace, from the floor upwards, sometimes as high as the tertiary air ports which are generally somewhat above the elevation of the liquor-spraying nozzles, must be protected from corrosion in various, expensive, ways. The smelt leaves the furnace through smelt spouts, located in one or more furnace walls just above the floor tubes.

In the soda process, most of the combustion occurs in suspension and the ash falls to the furnace bottom and leaves the furnace as molten smelt in the same fashion as the other recovery units which fire black liquor.

The floor of the furnace can be flat, in which case the smelt-spout openings are generally located some 200–300 mm above the floor. Thus a pool of smelt collects in the bottom of this type of furnace, which is called a "decanting" or "flat-floor" hearth, or "decanting" or "flat-floor" furnace.

The floor of the furnace can be sloped, generally at an angle of 5 to 10 degrees to the horizontal, towards one wall, in which case the smelt-spout openings are located at the lower end of the sloped floor. Much less smelt is present in the bottom of this type of furnace, which is called a "sloping-floor" hearth, or "sloping-floor" furnace.

In some sloping-floor furnaces, the smelt-spout openings are located some 100–300 mm above the floor. Thus a small pool of smelt also collects in this type of furnace. For the purposes of this discussion, this type of furnace is also designated a "sloping-floor" hearth, or "sloping-floor" furnace.

One or more liquor spray guns, or nozzles, may be employed in recovery boilers firing liquor from the kraft process, the soda process, the sodium-based sulphite process, and the closed-cycle CTMP process. The liquor guns are approximately 4 to 7 m above the furnace floor and are, generally, all at the same elevation. Where several liquor guns are employed, they are generally distributed around the periphery of the furnace. Excessive local deposition of liquor on the char bed causes local combustion upsets which, although not necessarily enough to disrupt the overall operation of the boiler, can cause local temperature variations and adversely affect the TRS emissions from the furnace, as discussed below. Two-wall primary air, as proposed in the method, minimizes such upsets.

When the liquor droplets in, or on, the char bed, or droplets in flight, are sufficiently dry, they pyrolize and burn, thereby forming combustion gases and releasing and/or forming other chemicals, some of which are carried upwards, as chemical fumes, by the combustion gases. The in-flight droplets that are too large to be carried out of the furnace by the up-flowing gases, fall to the bottom of the furnace on to the char bed or are deposited on the lower furnace walls where most of the droplets pyrolize and burn and, at some point, fall on to the char bed. Some of the lighter droplets, however, may be entrained by the flue gases and carried upwards into the upper regions of the boiler where the pendent heating surfaces, such as the superheater, generating bank and economizer, are located. Material carried upwards contributes to fouling of the heating surfaces and overloading of the ash hoppers, as noted above.

If an excessive quantity of wet liquor is deposited on any area of the char bed, or if the combustion air system fails to provide sufficient air to a particular region of the char bed, the combustion in that area is suppressed, the bed builds up there and local combustion falters or may cease and cause a "black-out" in that area of the bed on which the wet liquor has been deposited. The bed temperature is lowered in these regions of excessive liquor deposition or inadequate air supply and this causes an increase in the emission of sulphurous gases from these regions. If these sulphurous gases are imperfectly combusted, they contribute to the strength of rotten-egg-like odour typically emitted from such boilers. If the black-out is severe, expensive support fuel such as fuel oil or natural gas is required to restore the combustion and it may also be necessary to cease firing the liquor temporarily. If the char pile in the affected area becomes too high, it can topple over and block the primary air ports and/or cause char and molten smelt to enter the primary air registers through the air ports. In such instances, the boiler must generally be shut down to clean out the registers and repair any damage which may have resulted.

If the combustion in some area of the char bed is too intense, as a result of the local introduction of excessive quantities of combustion air, the surface of the char bed becomes too hot and excessive chemical fume is generated. This fume can condense on the pendent heating surfaces of the boiler. The fume particles increase the dust loading in the flue gases, and add to the capacity requirements of the electrostatic precipitator, a device used to remove particulate from the flue gases before they are discharged to atmosphere.

It is important to efficient boiler operation that the combustion of the injected liquor is completed as low down in the furnace as possible in order to minimize the gas temperatures in the pendent heating surfaces of the boiler. Excessive gas temperatures in the upper furnace are adverse because they cause the gas-borne deposits to become sticky, semi-molten, or molten, in which state they can adhere strongly to the heating surfaces. For the same reason, the liquor droplets should be retained in the lower furnace and burned there rather than have them carried into the upper furnace, either to burn, causing local high temperatures, or to adhere to the heating surfaces as unburned liquor.

Deposits which adhere to the heating surfaces reduce the heat-transfer to the surfaces. As much of these deposits as possible is therefore removed, using devices such as soot-blowers which generally utilize steam or high-pressure air, at considerable cost. It is therefore important to minimize the entrainment, or carryover, of liquor droplets and chemical fume in the flue gases rising from the furnace and to complete the combustion at as low an elevation in the furnace as possible. Both embodiments of the method improve combustion and reduce the carryover of particulate.

The primary air ports in recovery boilers are particularly subject to fouling and eventual blockage from frozen smelt and dried liquor. The random blockage of air ports reduces the air supply to related areas of the char bed and disrupts the combustion locally, as described above. The second embodiment of the invention reduces this port-fouling and minimizes the need for port rodding, either manually or by the use of automatic port-rodding equipment.

Combustion Air System in Boilers Burning Biomass, Wood Waste or Other Solid Fuel As noted above, the fuel in such boilers may burned on a grate, where the grate may be fixed, moving, horizontal or sloping, or in a fluidized bed.

The combustion air is admitted to the furnace of such boilers as undergrate air and as overfire air.

There may be several overfire air zones at various elevations above the fuel bed. These zones are named according to their elevations relative to the fuel bed. Successively higher zones are namely primary, secondary, tertiary, quaternary air, etc. Thus, the primary air is the air zone closest to the char bed. In some instances, the overfire air zones may be numbered in some fashion, depending on the preference of the boiler owner.

The gas-flow pattern in a furnace burning biomass, wood waste or other solid fuel, is created by the fuel distribution in the furnace, by the load-carrying and/or auxiliary burners and by the combustion air system.

Combustion Air System in Recovery Furnaces Firing Black Liquor

As noted above, the combustion air is admitted to this type of recovery furnace in several zones which are named according to their elevations relative to the char bed. Successively higher zones are namely primary, secondary, tertiary and, in the latest furnaces, quaternary air. Thus, the primary air is the air zone closest to the char bed.

Some older boilers have only two air zones: one below and one above the liquor guns.

Other older boilers and most modern boilers have at least three air zones: two below and one above the liquor guns.

An increasing number of modern boilers have four or more air zones: generally two zones below and the remaining zones above the liquor guns.

The primary air zone is generally about a meter above the surface of the char bed and is always below the elevation of the liquor guns.

The secondary air zone is generally one or two meters above the primary air zone and, except in older boilers of a certain design, is always below the elevation of the liquor guns.

The tertiary and quaternary combustion air zones are almost always above the elevation of the liquor guns.

The air ports of each zone are generally at a common elevation, but need not be. For example, in sloping-floor furnaces, the primary air ports on the sidewalls are generally located along the sides of a flat, sloping plane parallel to the floor. The primary air ports on the front and rear walls are generally located along the other two, horizontal sides of the said sloping plane. However, in such sloping-floor furnaces, the ports of the other air zones above the primary air zone are generally at a common elevation.

The openings through which the air is admitted, the air ports or nozzles, are located on one or more walls of the furnace, which is, typically, rectangular in horizontal cross-section. The ports on each wall are usually distributed evenly across the width of the wall and spaced according to the manufacturer's preference. The combustion air enters the ports from air registers which extend across all or part of each furnace wall.

Primary air is almost universally introduced through multiple, small, air ports on all four walls, as shown in FIG. 1, such that the quantity of air from each wall is approximately the same and the flow through individual ports is more or less equal. The inventors believe that there is only one recovery boiler in the world today (1999) which has primary air ports on two was only —namely at Tasman Pulp and Paper Limited in New Zealand, discussed above as Prior Art.

In the second embodiment of the proposed method, at least 80 percent of the primary air is introduced through ports on two opposing walls. In a conventional flat-floor furnace, the primary air jets are generally directed into the furnace at an angle of 0–5 degrees downwards from the horizontal, as shown in FIG. 2. In a conventional sloping-floor furnace, the primary air jets are generally directed into the furnace at an angle of approximately 30 degrees downwards from the horizontal, and originate from air ports located along the sides of a flat plane, inclined more or less parallel to the furnace floor, as shown in FIG. 3. The primary air registers are generally short and each register may have 4 to 10 small air ports, each port typically rectangular and 50 mm wide and 100 to 200 mm high. Each register has, typically, a single damper which controls the flow of air to the register, but there is most-often no constant-velocity control of each port.

Some boilers are equipped with a high-primary air system. This is a system of air ports, perhaps as much as 1 m above the primary air elevation, and supplied with air from ducting tapped off the primary air system. A booster fan may be employed for the high-primary air.

Secondary air may be introduced through air ports on all four walls, but is often introduced through ports on two opposing walls. The secondary air registers in a four-wall system are often short and each register may have 4 to 10 small air ports, each port typically rectangular and 50 mm wide and 100 to 200 mm high; each register generally has a single damper, as in the primary air system.

In a two-wall secondary air system, the registers may be continuous and extend across the full width of the wall; there are fewer ports and they are generally larger than the primary air ports, say, 100 mm wide and 300 mm high. The secondary air ports may have individual dampers which may, or may not, provide a constant velocity at the port opening.

In some older recovery boilers, the secondary air is introduced above the liquor guns from large air ports located close to the corners of a furnace which is often square, or nearly square in horizontal cross-section. The air from these corner ports creates a cyclonic action in the flue gases in the furnace, such that the axis of the cyclone is vertical.

Tertiary and quaternary air are generally introduced through a few air ports on two opposing walls, but may be introduced through ports on four walls or through ports on one wall only. These ports are typically the same size as, or larger than, those of the secondary air system and generally have individual dampers which may, or may not, provide a constant velocity at the port opening.

Again, in some boilers, the tertiary air is introduced from large air ports located close to the corners of a furnace which is often square, or nearly square. The air from these corner ports creates a cyclonic action in the flue gases in the furnace, such that the axis of the cyclone is vertical.

The gas-flow pattern in a recovery furnace is created largely by the combustion air system.

Primary Air Zones in Recovery Furnaces Firing Black Liquor

Where air jets issue from air ports on four walls at any elevation, the air jets from each wall interfere with the jets from the adjacent walls at right angles and force the air and the flue gases into a central column of relatively-rapidly-upward-flowing gases. This is shown in plan view in FIG. 1, and in elevation in FIGS. 2 and 3. With a two-wall primary air zone, or "2wp" zone, as shown in FIG. 4, as embodied in the proposed method, the same total primary air quantity as in the four-wall arrangement is used. In the method, the quantity of air through the ports of two opposing "inactive" walls is significantly reduced, in the limit, to zero, while the quantity of air through the ports of the two opposing "active" walls is therefore increased and, in the limit, essentially doubled; thus, as the quantity of air from the inactive walls decreases, there is less and less interference with the increasingly stronger jets from the active walls. Also, in the limit, the velocity of the jets issuing from the ports of the two "active" walls is therefore essentially double the velocity of the jets from the same walls in the four-wall arrangement.

The more powerful jets of the two-wall arrangement create a column of relatively-rapidly-upward-flowing gases in a region with a rectangular horizontal cross-section, but, as explained below, the upward velocity in this region is lower than the upward velocity in the central column created by the four-wall arrangement of jets. In the limit, this rectangular region extends across the full extent of the furnace width (or depth) with the long axis of the rectangle parallel to the walls from which the large air jets originate. This is shown in FIG. 4. The more powerful jets entrain more of the surrounding furnace gases, including combustible gases, into the air jets, thereby improving gas mixing and combustion.

Droplets from the liquor sprayers and particulate from the char bed can be preferentially captured and entrained by the gases in these high-velocity regions and, as described previously, carried out of the furnace.

It can be seen from FIGS. 1 and 4, that the area of the rectangle in FIG. 4 is greater than the area of the central column in FIG. 1. Since the amount of up-flowing gases is similar in both cases, the upward velocities in the larger rectangular region are thus slower than in the central column region. With lower upward velocities, the flow pattern created by the two-wall primary air-jet arrangement is less likely to entrain particulate in the upward-flowing gases than the pattern created by the four-wall arrangement.

Thus, it can be deduced that, in a system in which a large portion of the primary air is introduced from the ports in two opposing walls, while the remainder of the primary air is introduced from the two remaining walls, the liquor-droplet carryover will be less than in a furnace with the same total primary air flow distributed such that the flow from each of the four walls is more or less equal, but will be greater than in a furnace in which the same total primary air quantity is introduced from ports on two opposing walls only.

In a flat-floor furnace with a conventional combustion air system, the primary air ports on all four walls are generally all at the same elevation, as shown in FIG. 2. The primary air jets, directed horizontally or slightly downwards at an angle of 0–5 degrees, are directed in essentially the same horizontal plane P-P. The air velocity in the primary air ports is of the order of 25 to 30 m/s and, since the jets are small, they penetrate only some 2 m into the furnace. The profile of the char bed is relatively flat in the flat-floor furnace, particularly around the periphery of the furnace where these small primary air jets sculpt the char bed, often forming a low char rampart around the periphery of the furnace. Inside the peripheral band affected by the primary air jets, the char bed can be higher, since this area is unaffected by the relatively weak primary air jets.

In a sloping-floor furnace with a conventional air system, as shown in FIG. 3, the primary air ports on the spout wall are all at one elevation, designated P5 on FIG. 3. The primary air ports on the wall opposite the spout wall are also at a single, slightly higher, elevation, designated P1 on FIG. 3. The ports on the other two walls, designated the sidewalls for the purposes of this discussion, are typically arranged in horizontal groups of several ports, each group served by its register, and arranged such that the ports served by each register are at a common elevation, while the registers are at descending elevations, designated P1 through P5 on FIG. 3. The sidewall registers are thus more or less on the sides of a plane P1-P5 which is inclined and parallel to the sloping floor of the furnace. Typically, in a sloping-floor furnace, all the primary air jets are directed downwards at an angle of approximately 30 degrees as noted above.

Also in a sloping-floor furnace, as shown in FIG. 3, the profile of the char bed is not flat like the bed in the flat-floor furnace. In a sloping-floor furnace, the small primary airjets, directed downwards at approximately 30 degrees as noted, keep the char burned back, away from the furnace walls around the periphery of the furnace, forming a steep char rampart about 1 to 1.3 m from the walls as shown in FIG. 3. This rampart impedes jet penetration and deflects the air jets upwards into the furnace. In the region inside the char rampart created by the primary air jets, the char bed is higher and this area is completely unaffected by the primary air jets which are obstructed by the char rampart.

Thus, in both the flat-floor and sloping-floor furnaces that have conventional four-wall primary air, the primary air is confined to a relatively small area around the perimeter of the furnace. Since the oxygen in the air jets is restricted to a confined area, the temperatures near the walls are unnecessarily high, causing excessive local $NO_x$ and fume generation and metal wastage can occur. On the other hand, the centre of the furnace is relatively cooler. In this cooler region in the centre of the char bed surface, TRS and carbon monoxide emissions may be excessive.

Conventional thinking suggests that, to minimize fume generation and metal wastage in the lower furnace, the combustion should be delayed and displaced to higher elevations in the furnace. Typically, the primary air flow is reduced and the other, higher-elevation air flows are increased correspondingly. This reduces the temperature immediately above the char bed around the perimeter of the furnace and reduces fume generation and metal wastage. However, the lower temperature generally results in lower reduction efficiencies and sometimes higher TRS emissions from the furnace. The extremely expensive heating surface of the furnace is under-utilized and the boiler thermal efficiency suffers.

Further, Prouty, Stuart and Caron indicated in their paper "Nitrogen oxide emissions from a kraft recovery furnace" (Tappi, Vol. 76, No.1) that, although the $NO_x$ emissions were reduced when the oxygen concentration was reduced, the carbon monoxide (CO) emissions increased five-fold. In the technical paper "Novel air systems for kraft recovery boilers", by Colin MacCallum, presented at a meeting of the Black Liquor Recovery Boiler Advisory Committee (BLRBAC), in Atlanta, Ga., USA, on Oct. 6, 1993, it is explained that decreases in the primary and secondary air quantities reduce both gas mixing and combustion at these elevations. The reduced gas mixing allows the oxygen-rich zone around the perimeter of the char bed (where the primary jets are), and the CO-rich zone in the centre of the furnace, to persist, rather than be broken up by the secondary air jets which would be more aggressive at a higher flow.

A two-wall primary air arrangement has more powerful jets issuing from the two active walls as noted above. These powerful jets burn the char bed back farther into the furnace and, where the jets are directed in an opposed or partly-opposed fashion as proposed in the method, essentially eliminate the char ramparts otherwise formed by the four-wall arrangements. The stronger jets penetrate farther into the furnace and provide better gas mixing, as described. Thus, better gas mixing, as provided by two-wall primary air, would reduce the CO emissions, because, with two-wall primary air, the bed height is controlled by the primary air jets which penetrate deep into the furnace and consume the CO, whereas, with the four-wall system, the relatively weak jets form an oxygen-rich zone around the perimeter of the furnace.

The proposed method of achieving two-wall primary air in a boiler burning liquor from the kraft process, the soda process, the sodium-based sulphite process, and the closed-cycle CTMP process, applies primarily to sloping-floor furnaces, but could be applied to flat-floor furnaces where new primary air ports are installed in a plane which is not horizontal. In the method, as applied to an existing sloping-floor furnace with four-wall primary air, some, or most, of the primary air would be shut off from two opposing walls. The primary air thus shut off would be directed to the other two walls in roughly equal proportions. Thus, the primary air quantity from the remaining two "active" opposing walls would be correspondingly increased, such that the total primary air quantity remains substantially the same as before. That is, the velocity in the primary air ports of the active walls would be increased, or, in the limit, doubled. The remaining small quantity of primary air, as applicable, is essentially equally distributed between the two "inactive" walls.

A three-month trial with two-wall primary air was conducted on a sloping-floor boiler at Mackenzie, BC. As explained in MacCallum's technical paper "Novel air systems for kraft recovery boilers", referred to earlier in this discussion, after some three months it was suddenly found that the steeply-sloping higher-velocity primary air jets from the two active walls were digging into the char bed and creating a very distinct rampart of char some 1.8 to 2.1 m from the two active walls. This char rampart had probably existed all the time following the adoption of 2wp, but it suddenly appeared to the operators as though char particles were being swept up the face of the char rampart and entrained in the flue gases, so, conventional four-wall operation was restored.

At the time of this trial, and until early 1999, the inventors were concerned that, if the method were applied to a sloping-floor furnace using the existing steeply-sloping ports, the more powerful air jets from the two active walls might cut into the char bed and could damage the floor tubes. It was thought that, to avoid such damage, the jets from the two active walls must be directed more or less horizontally from the sidewalls or essentially parallel to the floor from the front and rear walls. Therefore, new primary air ports in the active sidewalls, directed more or less horizontally, would be installed; or new primary air ports directed essentially parallel to the floor would be installed in the front and rear walls. As an alternative to new air ports, inserts would be installed in existing ports to direct the primary air at the desired angle from the active walls. The conventional arrangement of such ports angled downwards at approximately 30 degrees is shown in FIG. 11 and a simple insert to direct the air at the desired angle is illustrated.

The inventors now believe that such inserts are not required. The inventors have since reviewed this concern about the floor tubes being endangered by steeply-sloping air jets and have concluded that, given an air-jet velocity of about 150 ft/s with 2wp, combined with the low angle of approach to the floor tubes, it is unlikely that any damage to the floor could occur, even if it were bare. The fact that Mackenzie ran the boiler with 2wp for three months, problem-free, supports this view. Prudence suggests, however, that the primary air jets should be directed in an opposed or partly-opposed fashion as in the proposed method.

The air ports in the inactive walls of an existing furnace need not be modified, since the jets are created by a smaller quantity of air, for example, leakage air through the dampers, and are relatively weak.

In the method, the plane of the primary air jets, that is, the plane which passes through the primary air ports on all walls from which the primary air jets originate, is inclined, as shown in FIG. 5. The larger jets from the active walls can be along either the horizontal planes P1 and P5 on the front and rear walls, or on the sloping plane P1-P5 on the sidewalls, or, in a specific case, parallel to the sloping floor of the furnace. FIG. 6 shows the proposed active two-wall primary air jets from the spout wall and from the wall opposite the spout wall. FIG. 7 shows a section through Register P3 of the furnace where the active two-wall primary air jets are introduced from the sidewall registers at elevations P1 through P5.

In the method, when the primary air flow is maintained at its four-wall flow rate, but injected through two walls only, the air velocity essentially doubles and the jets sculpt the bed profile more easily than the slower jets of the four-wall arrangement. When the jets are directed essentially horizontally into the furnace from the sidewalls, or essentially parallel to the floor from the front and rear walls, the jets penetrate farther into the furnace and sweep across the surface of the bed, to the centre of the furnace. This results in more effective combustion across the entire cross-section of the furnace and leads to the higher average temperatures which have been observed. The combustion is no longer concentrated around the perimeter, so the temperatures at the walls, especially the walls with the closed ports, or no ports, should be lower and the metal wastage should be less.

With two-wall primary air directed in the proposed manner, the bed profile is relatively flat, with a central ridge parallel to the walls from which the jets issue. In a furnace originally designed for four-wall primary air, and operating with two-wall primary air, the height of the central ridge of the char bed is generally somewhat higher than the elevation of the air ports on the "inactive" walls. In order to prevent the char and associated smelt from entering the ports at the centre of the inactive walls, additional air is introduced through the air ports at the centre of the inactive walls; this air also sculpts the bed, more weakly than the stronger jets from the active walls, and pushes the central ridge away from these ports at the centre of the inactive walls. That is, close to the inactive walls, the central ridge is lower than the rest of the ridge.

Obviously, in a furnace originally designed for two-wall primary air, there would be no ports on the inactive walls, so the central ridge of the char bed can extend right to the inactive walls.

As discussed above, in a conventional sloping-floor boiler utilizing four-wall primary air, the char bed is piled up by the steeply-sloping primary air jets from all four walls. Further, the top of the char bed is cut off by the secondary air jets which have relatively high velocity in a modern system. This means that a large proportion of the combustion air is injected close to the surface of the bed. Combustion close to the bed promotes high temperatures and fume generation.

On the other hand, two-wall primary air creates a flat char bed, subjected only to the action of the primary air jets. The surface of the char bed is well below the secondary air jets. That is, the bed surface is directly affected by less of the total air quantity. Thus, fume generation from the char bed is likely to be lower when two-wall primary air is employed.

With 2wp, the temperatures at the walls can be further reduced by reducing the primary air quantity in the same way as for the four-wall set-up. With 2wp, in the method, a reduction in the primary air quantity has fewer adverse effects than it would have with four-wall primary air. With the two-wall arrangement, even with a reduced primary-air quantity, the air velocity from the active walls is significantly higher than with the four-wall arrangement, so the char bed is shaped much more easily with less primary air.

The combustion will still be more effective than the combustion with the four-wall mode of operation and the furnace will still be utilized more fully, because the combustion is occurring lower in the furnace. Experience has shown that the primary air flow (and total air flow) can be reduced by some 5 percentage points with 2wp, while maintaining the same degree of char-bed control.

The added, expected bonuses of two-wall primary air operation are that the furnace is utilized more fully and the overall thermal efficiency is higher.

In a sloping-floor recovery furnace, the method comprises introducing the primary combustion air which is being introduced into the furnace at the lowest air zone in the furnace, in jets from two opposing walls and, where applicable, in relatively small jets from the third and fourth walls of the furnace, such that the jets from the first two opposing walls are formed by at least 80 percent of the air being introduced at this lowest air zone. Further, the jets from the first two opposing walls are essentially opposed jets as shown in FIG. 10, with the jets directed essentially in an inclined plane.

In a new furnace designed for two-wall primary air, all the combustion air would be admitted from two opposing walls only, thus halving the number of primary air ports. Considering that, in a modern boiler, each air port would be fitted with automatic port-rodding equipment, the potential capital cost savings are significant.

However, although the two-wall primary air system using multiple ports is more effective than the conventional four-wall system, it has the disadvantage that there is still a large region of relatively high upward gas velocities in the furnace. Ideally, the upward velocity extremes should be minimized, that is, the upward gas velocities across the furnace cross-sectional plan area should be as close to the average upward gas velocity as possible, in order to minimize liquor-droplet and particulate entrainment.

Therefore, the inventors propose that the most effective form of two-wall primary air would be a true two-wall arrangement (that is, an arrangement with jets from two walls only) employing a few, large, partially-interlaced air jets, as proposed in the first embodiment of this invention and as discussed in more detail below, instead of the multiple small air ports of the second embodiment. In this case, the costs of the ports and port-rodding equipment would be further reduced.

Secondary Air Zones in Recovery Furnaces Firing Black Liquor

The central column of rapidly-upward-flowing gases which is created by a four-wall primary air arrangement, and the larger rectangular region of somewhat-less-rapidly upward-flowing gases created by a two-wall primary air arrangement, can either be accentuated or dissipated to some extent by the air jets from the secondary air zone, depending on the arrangement of the secondary air jets.

A four-wall secondary air arrangement reinforces the central column of upward-flowing gases which is created by a four-wall primary air arrangement. However, some two-wall secondary air systems can dissipate the central column of gases.

Two particularly-effective two-wall secondary air arrangements are the subject of this discussion:

a partially-interlaced arrangement of air jets a fully-interlaced arrangement of air jets.

A partially-interlaced air-jet arrangement consists of a two-wall pattern of large and small air jets on each active wall. Each large jet is opposed by a small jet. The jets are arranged so that their size alternates small/large/small/large, etc. across the width, or depth of the furnace on each active wall as shown in FIG. 8. The pattern may be symmetrical, but need not be symmetrical. In the prior art discussed above, Blackwell and MacCallum have shown that a partially-interlaced secondary air-jet arrangement in a horizontal plane minimizes the velocity extremes in the upward-flowing gases in a furnace. Further, Jones, Chapman and Mahaney, in their paper "Improved air port arrangements for the secondary air level" (Pulp & Paper Canada 94:9 [1993]) have shown that a partially-interlaced secondary air-jet arrangement in a horizontal plane improves gas mixing. In FIG. 8, the corners of the plane of the jets are designated A, B, C and D. In the first embodiment of the method, the jets are introduced essentially in the non-horizontal plane ABCD; this plane can be flat (FIGS. 13 and 16) or curved (FIGS. 14, 15, 17, and 18). The air jets may be directed in an opposed or partly opposed fashion, that is, they may be directed in the said plane, or directed slightly downwards, or slightly upwards from the said plane, or slightly left in the plane, or slightly right in the plane. Further, the plane can be inclined in the direction of jet flow (FIGS. 13, 14, and 15), or at right angles (FIGS. 16, 17, and 18) or skewed to the direction of jet flow.

A fully-interlaced air-jet arrangement consists of a two-wall pattern of similarly-sized air jets which are unopposed by similar jets from the opposite wall. The jets are arranged as shown in FIG. 9. The pattern may be symmetrical, but need not be symmetrical. In the prior art discussed above, Jones, Chapman and Mahaney, have shown that a fully-interlaced secondary air-jet arrangement in a horizontal plane improves gas mixing slightly more than a partially-interlaced arrangement in a horizontal plane. However, Blackwell and MacCallum have shown that a fully-interlaced secondary air-jet arrangement in a horizontal plane does not minimize the velocity extremes in the upward-flowing gases in a furnace to the same extent as a partially-interlaced air-jet arrangement in a horizontal plane. Also, the fully-interlaced arrangement is more sensitive to flow-rate changes; it may suffer lack of jet penetration and/or excessive jet penetration when operated at loads other than the design load. Lack of jet penetration at low loads results in poor gas mixing at the ends of the weak jets. Excessive jet penetration at high loads leads to regions of high upward velocity at the ends of the strong jets and the potential for impingement on and damage to the wall tubes.

Clearly, by the addition of small air jets opposite the existing jets, the fully-interlaced air-jet arrangement can be converted to a partially-interlaced arrangement. In this way, the capacity of the particular air zone is increased. A partially-interlaced arrangement can operate as a fully-interlaced arrangement by the simple expedient of closing the dampers associated with the small jets, but the capacity of the particular air zone to supply combustion air is decreased.

On balance, a fully-interlaced arrangement of air jets is less attractive than a partially-interlaced arrangement.

As noted above, because the gas mixing in the furnace is ineffective, many boilers employ excessive quantities of combustion air in an attempt to complete the combustion. If recycled flue gas is introduced into the furnace in the said partially-interlaced jets, alone or in place of all, or some, of the portion of the combustion air which would otherwise be introduced through these jets, gas mixing is also improved, because the said jets whether or not they contain combustion air, still contribute to better gas mixing, by entraining the furnace gases surrounding the jets, into the jets. The principle advantage of using recycled flue gas in place of some of the combustion air is that the excess air is reduced and, thereby, the thermal efficiency of the boiler is increased.

Partially-interlaced Air-jet Arrangements in Boilers Firing Red Liquor or Boilers Firing Wood Waste, Biomass or Other Solid Fuel The velocity of the combustion gases in boilers firing red liquor or boilers firing wood waste, biomass or other solid fuel, is generally not constant over the horizontal cross-section of the furnace. That is, velocity extremes occur in these furnaces and promote entrainment of particulate into the combustion gas stream leaving the furnace.

The partially-interlaced air-jet arrangement described above, may also be employed in this type of boiler to minimize such velocity extremes and thereby minimize entrainment of particulate.

Again, if recycled flue gas is introduced into the furnace in the said partially-interlaced jets, alone or in place of all, or some, of the said portion of combustion air, gas mixing is also improved, because the said jets whether or not they contain combustion air, still contribute to better gas mixing, by entraining the furnace gases surrounding the jets, into the jets.

Combination of Jets

In any arrangement of air jets, when two or more air ports are relatively close together, at a certain distance from the wall the jets combine to form a single jet. For the purposes of this discussion, this combining of jets is referred to as the "register" effect. This register effect can be used to create the desired partially-interlaced arrangement of air jets in the method. For example, FIG. 12 shows a large jet created by the combination of two smaller jets. Thus, for ease of manufacture, in a partially-interlaced system the air ports can be all the same size, while the large jets are created by combining two or more small jets.

In the method, the large jets can be created by rows, columns, groups or clusters of smaller jets, or by increasing the pressure at the air port or combination of ports. For example, the partially-interlaced method can be applied at the primary air zone in a sloping-floor furnace. In this case, ideally, the air would be introduced from two opposing walls only. In practice, however, in an existing boiler with conventional four-wall primary air, a small quantity of air might leak through the closed dampers of ports on the other two, inactive, walls. Further, each small jet could be created by reducing the air flow to one register which, in turn, feeds several primary air ports. The small jets thus created, would combine to form a single "small" jet. Each large jet would be created by the combination of the several more powerful jets fed from each register for which the damper remained fully open.

Coordination of Liquor-spraying and Air Systems in Boilers Firing Black Liquor

When a central region of relatively rapidly upward-flowing gases is created by a four-wall or two-wall primary air-jet arrangement in boilers firing liquor from the kraft process, the soda process, the sodium-based sulphite process, and the closed-cycle CTMP process, the region tends to persist to an elevation above the liquor guns, for many arrangements of secondary, tertiary and quaternary air ports. In this instance, it is advantageous to spray the liquor into the areas of the furnace outside this high-upward-velocity region, where the furnace gases tends to be flowing downwards.

The down-flow of the furnace gases around the central column of upward-flowing gases, as illustrated in FIGS. 2 and 3, is created by the entrainment of furnace gases into the primary air jets. The more powerful the primary air jets, the more pronounced is the down-flow.

The particles and droplets sprayed into these regions of downward-flowing gases tend to be carried downwards on to the char bed. Thus, coordination of the liquor spraying and the two-wall arrangement of primary air jets can result in fewer liquor droplets being carried out of the furnace by the flue gas stream.

Two-wall primary air operation provides well-defined areas of downward-flowing furnace gases, along the active walls, into which areas the liquor droplets can be sprayed to minimize carryover of droplets and particulate in the flue gas leaving the furnace. Droplets which are inadvertently sprayed into the central, upward-flowing region formed by a two-wall primary air arrangement are less liable to be entrained than with the four-wall primary air arrangement, because the upward velocity in the central region is lower than with a four-wall arrangement.

Thus, coordination of the liquor spraying with the air system is particularly complementary to two-wall primary air operation because, with 2wp there are two well-defined down-flow regions —each being the full width of the furnace, above the primary air jets which are in use. The liquor can be sprayed into these down-flow regions and the droplets fall to the char bed at places where a large amount of oxygen is supplied via the high-velocity primary jets; both the large oxygen supply and the high velocity of the jets enhance the burning of the char. This permits operation with a larger droplet size which also helps to reduce particle entrainment, or carryover. The high-velocity primary air jets also facilitate shaping of the bed, as mentioned.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

We claim:

1. A method of introducing a portion of the combustion air, or some portion of recycled flue gas in place of all, or some of the said portion of the combustion air, at any elevation into: a furnace firing black liquor from the kraft recovery process, a furnace firing black liquor from the soda process, a furnace firing black liquor from the sodium-based sulphite process, a furnace firing black liquor from the closed-cycle CTMP process, a furnace firing liquor from the magnesium-based sulphite process, a furnace firing liquor from the ammonium-based sulphite process, and furnaces of boilers burning biomass, wood waste or other solid fuel, said method comprising:

a. introducing air, or air and recycled flue gas, at the particular elevation as jets from two, opposite, first and second, hereinafter-called "active", sides of an inclined plane which is bounded, respectively, by the first and second, hereinafter-called "active", walls of the interior of the furnace and by the third and fourth, hereinafter-called "inactive", walls of the interior of the furnace, such that the jets are arranged in a partially-interlaced pattern of large and small jets, wherein each large jet is opposite a small jet originating from the opposite wall, and the jets are arranged small/large/small/large, etc., in an alternating pattern along the length of each of the said two active sides of the said plane;

b. distributing the flow of said air, or said air and said recycled flue gas, such that the total flow from each of the two opposite "active" sides of the said plane is more or less equal;

c. directing the said jets in a fully-opposed or partly-opposed juxtaposition relative to the said plane;

d. the said plane is essentially flat, or, one first side of the said plane is curved, or, both first and second sides of the said plane are curved.

2. The method as in claim 1 in which:

The said plane is inclined such that the direction of the incline is parallel to the direction of flow of the jets.

3. The method as in claim 1 in which:

The said plane is inclined such that the direction of the incline is at right angles to the direction of flow of the jets.

4. The method as in claims 2 or 3 wherein:

The large and small jets featured in the partially-interlaced pattern can originate from corresponding large and small ports.

5. The method as in claim 4, wherein all of the said air and/or recycled flue gas that is introduced into the furnace at the elevation of the said plane is distributed through the first and second walls.

6. The method as in claim 4, further including an arrangement of jets originating from the third and fourth inactive sides of the said plane which is bounded by the four walls of the interior of the furnace, and the said air and/or recycled flue gas that is introduced into the furnace at the elevation of the said plane is distributed so that most of the said air and/or recycled flue gas is introduced more or less equally through the first and second walls and a small portion of the said air and/or recycled flue gas is introduced through the third and fourth walls.

7. The method according to claim 6 wherein:

The flow from each of the two opposite, third and fourth sides of the said plane is about equal.

8. The method as in claims 2 or 3 wherein:

Each small jet featured in the partially-interlaced pattern can originate from a group or cluster of small ports and each large jet can originate from a group or cluster of large ports.

9. The method as in claim 8 wherein all of the said air and/or recycled flue gas that is introduced into the furnace at the elevation of the said plane is distributed through the first and second walls.

10. The method as in claim 8 including an arrangement of jets originating from the third and fourth inactive sides of the said plane which is bounded by the four walls of the interior of the furnace, and the said air and/or recycled flue gas that is introduced into the furnace at the elevation of the said plane is distributed so that most of the said air and/or recycled flue gas is introduced more or less equally through the first and second walls and a small portion of the said air and/or recycled flue gas is introduced through the third and fourth walls.

11. The method as in claims 2 or 3 wherein:

The large and small jets featured in the partially-interlaced pattern can originate from ports of similar size and number, and the large jets can be created by a higher air pressure than the pressure creating the small jets.

12. The method as in claim 11 wherein all of the said air and/or recycled flue gas that is introduced into the furnace at the elevation of the said plane is distributed through the first and second walls.

13. The method as in claim 11 including an arrangement of jets originating from the third and fourth inactive sides of the said plane which is bounded by the four walls of the interior of the furnace, and the said air and/or recycled flue gas that is introduced into the furnace at the elevation of the said plane is distributed so that most of the said air and/or recycled flue gas is introduced more or less equally through the first and second walls and a small portion of the said air and/or recycled flue gas is introduced through the third and fourth walls.

14. The method as in claims 2 or 3 wherein:

Each small jet featured in the partially-interlaced pattern can originate from a group or cluster of similarly-sized ports and each large jet can originate from a larger group or cluster of ports of similar size to the ports from which the said small jets originate.

15. The method as in claim 14, in which:

Each small jet can originate from a single port and each large jet can originate from a pair of similarly sized ports.

16. The method as in claim 14 wherein all of the said air and/or recycled flue gas that is introduced into the furnace at the elevation of the said plane is distributed through the first and second walls.

17. The method as in claim 14 including an arrangement of jets originating from the third and fourth inactive sides of the said plane which is bounded by the four walls of the interior of the furnace, and the said air and/or recycled flue gas that is introduced into the furnace at the elevation of the said plane is distributed so that most of the said air and/or recycled flue gas is introduced more or less equally through the first and second walls and a small portion of the said air and/or recycled flue gas is introduced through the third and fourth walls.

18. The method as in claim 15, in which:

Some or all of the area of the single port can be substantially opposite to at least some of the area defined by the pair of ports.

19. The method as in claim 15, in which:

Some or all of the area of the single port can be opposite the area defined by the pair of ports.

20. A recovery boiler furnace firing black liquor from the kraft process, a recovery boiler furnace firing black liquor from the soda process, a recovery boiler furnace firing black liquor from the sodium-based sulphite process, a recovery boiler furnace firing black liquor from the closed-cycle CTMP process, a recovery boiler furnace firing liquor from the magnesium-based sulphite process, a recovery boiler furnace firing liquor from the ammonium-based sulphite process, and boiler furnaces burning biomass, wood waste or other solid fuel, which utilize injected air or some portion of recycled flue gas in place of all, or some of the said combustion air, comprising:

a. A furnace chamber having four walls;

b. On one first wall of the interior of the furnace, a first set of similar-sized large and small ports, or similar sized groups of similar sized ports, located essentially along one first side of an inclined plane which is bounded by the walls of the interior of the furnace;

c. The said plane is essentially flat, or, one first side of the said plane is curved, or, both first and second sides of the said plane are curved;

d. On the second wall, opposite the first wall of the interior of the furnace, a second set of ports, similar in size and number to the ports of the first set, or a second set of groups of ports in which the number of groups is similar to the number of groups in the first set and the ports in the groups are similar in size and number to the ports in the groups of the first set, and located essentially along one second side of the said plane;

e. Dampers are associated with the ports, or groups of ports, on both the first and second walls, for restricting the flow of air or of air and flue gas through the ports, said dampers being operated such that the flow through alternating ports, (that is, every second port), or through alternating groups of ports, (that is, every second group of ports), on each of the first and second walls is less than the flow through the remaining, also alternating ports, or alternating groups of ports;

f. Said ports, or groups of ports, in the second set through which the flow is less restricted being oriented such that the large jet which issues from these ports, or groups of ports, essentially opposes the small jet which issues from the correspondingly oriented ports, or groups of ports, in the first set through which the flow is more restricted;

g. Said ports, or groups of ports, in the second set through which the flow is more restricted being oriented such that the small jet which issues from these ports, or groups of ports, essentially opposes the large jet which issues from the correspondingly oriented ports, or groups of ports, in the first set through which the flow is less restricted;

h. Said ports are oriented to direct the said jets in a fully-opposed or partly-opposed juxtaposition relative to the said plane.

21. The furnace as defined in claim 20 wherein:

The said dampers are located at the port openings such that, when the dampers are operated, the size of the opening is reduced.

22. The furnace as defined in claim 21, in which:

The said plane is inclined such that the direction of the incline is parallel to the direction of flow of the partially-interlaced jets.

23. The furnace as defined in claim 21, in which:

The said plane is inclined such that the direction of the incline is at right angles to the direction of flow of the partially-interlaced jets, that is, the said plane is inclined such that the sides of the said plane which are parallel to the direction of flow of the partially-interlaced jets are at different elevations.

24. The furnace as defined in claim 20 wherein:

The said dampers are located upstream of the port openings such that, when the dampers are operated, the pressure at the ports is reduced.

25. The furnace as defined in claim 24, in which:

The said plane is inclined such that the direction of the incline is parallel to the direction of flow of the partially-interlaced jets.

26. The furnace is defined in claim 24, in which:

The said plane is inclined such that the direction of the incline is at right angles to the direction of flow of the partially-interlaced jets, that is, the said plane is inclined such that the sides of the said plane which are parallel to the direction of flow of the partially-interlaced jets are at different elevations.

27. A recovery boiler furnace firing black liquor from the kraft process, a recovery boiler furnace firing black liquor from the soda process, a recovery boiler furnace firing black liquor from the sodium-based sulphite process, a recovery boiler furnace firing black liquor from the closed-cycle CTMP process, a recovery boiler furnace firing liquor from the magnesium-based sulphite process, a recovery boiler furnace firing liquor from the ammonium-based sulphite process, and boiler furnaces burning biomass, wood waste or other solid fuel, which utilize injected air or some portion of recycled flue gas in place of all, or some of the said combustion air, comprising:

a. A furnace chamber having four walls;

b. On one first wall of the interior of the furnace, a first set of large and small ports located essentially along one first side of an inclined plane which is bounded by the walls of the interior of the furnace;

c. On the second wall, opposite the first wall of the interior of the furnace, a second set of large ports and small ports, located essentially along one second side of the said plane;

d. The said plane is essentially flat, or, one first side of the said plane is curved, or, both first and second sides of the said plane are curved;

e. Said large ports in the second set being of similar size to the large ports of the first set and said small ports in the second set being of similar size to the small ports of the first set;

f. Said large ports in the second set being oriented such that the jet which issues from these ports essentially opposes the said small jets which issue from the correspondingly oriented small ports in the first set;

g. Said small ports in the second set being oriented such that the jet which issues from these ports essentially opposes the said large jets which issue from the correspondingly oriented large ports in the first set;

h. Said large ports on the first wall of the furnace alternating with the said small ports across the same wall;

i. Said large and small ports are oriented to direct the said jets in a fully-opposed or partially-opposed juxtaposition relative to the said plane.

28. The furnace as defined in claim 27, in which:

The said plane is inclined such that the direction of the incline is parallel to the direction of flow of the partially-interlaced jets.

29. A furnace according to claim 28, in which:

All of the said air and/or recycled flue gas that is introduced to the furnace at the elevation of the said plane is distributed in substantially equal portions through the first and second walls.

30. A furnace according to claim 28 in which:

Air ports are included on the third and fourth sides of the said plane which is bounded by the four walls of the interior of the furnace, and the said air and/or recycled flue gas that is introduced to the furnace at the elevation of the said plane is distributed so that most of the said air and/or recycled flue gas is distributed in substantially equal portions through the first and second walls and a small portion of the said air and/or recycled flue gas is introduced through the third and fourth walls.

31. The furnace as defined in claim 30, in which:

The said small portion of the said air and/or recycled flue gas introduced through the third and fourth walls is distributed substantially equally through the third and fourth walls.

32. The furnace as defined in claim 27, in which:

The said plane is inclined such that the direction of the incline is at right angles to the direction of flow of the partially-interlaced jets, that is, the said plane is inclined such that the sides of the said plane which are parallel to the direction of flow of the partially-interlaced jets are at different elevations.

33. A furnace according to claim 32, in which:

All of the said air and/or recycled flue gas that is introduced to the furnace at the elevation of the said plane is distributed in substantially equal portions through the first and second walls.

34. A furnace according to claim 32, in which:

Air ports are included on the third and fourth sides of the said plane which is bounded by the four walls of the interior of the furnace, and the said air and/or recycled flue gas that is introduced to the furnace at the elevation of the said plane is distributed so that most of the said air and/or recycled flue gas is distributed in substantially equal portions through the first and second walls and a small portion of the said air and/or recycled flue gas is introduced through the third and fourth walls.

35. The furnace as defined in claim 34, in which:

The said small portion of the said air and/or recycled flue gas introduced through the third and fourth walls is distributed substantially equally through the third and fourth walls.

36. A recovery boiler furnace firing black liquor from the kraft process, a recovery boiler furnace firing black liquor from the soda process, a recovery boiler furnace firing black liquor from the sodium-based sulphite process, a recovery boiler furnace firing black liquor from the closed-cycle CTMP process, a recovery boiler furnace firing liquor from the magnesium-based sulphite process, a recovery boiler furnace firing liquor from the ammonium-based sulphite process, and boiler furnaces burning biomass, wood waste or other solid fuel, which utilize injected air or some portion of recycled flue gas in place of all, or some of the said combustion air, comprising:

a. A furnace chamber having four walls;

b. On one wall of the interior of the furnace, a first set of large groups, or clusters, of ports and smaller groups, or clusters of ports, located essentially along one first side of an inclined plane which is bounded by the walls of the interior of the furnace, all said ports of the said first set being of similar size;

c. The said plane is essentially flat, or, one first side of the said plane is curved, or, both first and second sides of the said plane are curved;

d. On the wall opposite the first wall of the interior of the furnace, a second set of large groups, or clusters, of ports and smaller groups, or clusters, of ports, and located essentially along one second side of the said plane, all said ports of the said second set being of similar size to those of the first set;

e. Said large groups, or clusters, of ports in the second set having a similar number of ports as the said large groups or clusters of ports in the first set;

f. Said smaller groups, or clusters, of ports in the second set having a similar number of ports as the said smaller groups or clusters of ports in the first set;

g. Said large groups, or clusters, of ports in the second set being oriented such that the combined, large, jet which issues from these ports essentially opposes the combined, small, jet which issues from the correspondingly oriented groups, or clusters, of small ports in the first set;

h. Said smaller groups, or clusters, of ports in the second set being oriented such that the combined, small, jet which issues from these ports essentially opposes the combined, large, jet which issues from the correspondingly oriented groups, or clusters, of large ports in the first set;

i. Said large groups, or clusters, of ports alternating across the first wall of the furnace with the said smaller groups, or clusters, of ports on the same wall;

j. Said ports in the large and smaller groups, or clusters, are oriented to direct the said jets in a fully-opposed or partly-opposed juxtaposition relative to the said plane.

37. The furnace as defined in claim 36 in which:

Each smaller group, or cluster, of ports can comprise a single port and each large group, or cluster, of ports can comprise a pair of similarly sized ports.

38. The furnace as defined in claim 37 in which:

Some or all of the area of the single port can be substantially opposite to at least some of the area defined by the pair of ports.

39. The furnace as defined in claim 37 in which:

Some or all of the area of the single port can be opposite the area defined by the pair of ports.

40. The furnace as defined in claim 36, in which:

The said plane is inclined such that the direction of the incline is parallel to the direction of flow of the partially-interlaced jets.

41. The furnace as defined in claim 36, in which:

The said plane is inclined such that the direction of the incline is at right angles to the direction of flow of the partially-interlaced jets, that is, the said plane is inclined such that the sides of the said plane which are parallel to the direction of flow of the partially-interlaced jets are at different elevations.

42. A recovery boiler furnace firing black liquor from the kraft process, a recovery boiler furnace firing black liquor from the soda process, a recovery boiler furnace firing black liquor from the sodium-based sulphite process, a recovery boiler furnace firing black liquor from the closed-cycle CTMP process, a recovery boiler furnace firing liquor from the magnesium-based sulphite process, a recovery boiler furnace firing liquor from the ammonium-based sulphite process, and boiler furnaces burning biomass, wood waste or other solid fuel, which utilize injected air or some portion of recycled flue gas in place of all, or some of the said combustion air, comprising:

a. A furnace chamber having four walls;

b. On one first wall of the interior of the furnace, a first set of groups, or clusters, of large ports and groups, or clusters, of small ports located essentially along one first side of an inclined plane which is bounded by the walls of the interior of the furnace;

c. On the second wall, opposite the first wall of the interior of the furnace, a second set of groups or clusters, of large ports and groups, or clusters, of small ports, located essentially along one second side of the said plane;

d. The said plane is essentially flat, or, one first side of the said plane is curved, or, both first and second sides of the said plane are curved;

e. Said large ports in the second set being of similar size to the large ports of the first set and said small ports in the second set being of similar size to the small ports of the first set;

f. Said groups, or clusters, of large ports in the second set having a similar number of ports as the said groups or clusters of large ports in the first set;

g. Said groups, or clusters, of small ports in the second set having a similar number of ports as the said groups or clusters of small ports in the first set;

h. Said groups, or clusters, of large ports in the second set being oriented such that the combined, large, jet which issues from these ports essentially opposes the combined, small, jet which issues from the correspondingly oriented groups, or clusters, of small ports in the first set;

i. Said groups, or clusters, of small ports in the second set being oriented such that the combined, small, jet which issues from these ports essentially opposes the combined, large, jet which issues from the correspondingly oriented groups, or clusters, of large ports in the first set;

j. Said groups, or clusters, of large ports alternating across the first wall of the furnace with the said groups, or clusters, of small ports on the same wall;

k. Said large and small ports are oriented to direct the said jets in a fully-opposed or partially-opposed juxtaposition relative to the said plane.

43. The furnace as defined in claim 42, in which:

The said plane is inclined such that the direction of the incline is parallel to the direction of flow of the partially-interlaced jets.

44. The furnace as defined in claim 42, in which:

The said plane is inclined such that the direction of the incline is at right angles to the direction of flow of the partially-interlaced jets, that is, the said plane is inclined such that the sides of the said plane which are parallel to the direction of flow of the partially-interlaced jets are at different elevations.

* * * * *